US010113816B2

(12) United States Patent
Akiyoshi et al.

(10) Patent No.: US 10,113,816 B2
(45) Date of Patent: Oct. 30, 2018

(54) AIR-CONDITIONING INDOOR UNIT WITH AXIAL FANS AND HEAT EXCHANGER PARTITION

(75) Inventors: Masao Akiyoshi, Chiyoda-ku (JP); Satoshi Michihata, Chiyoda-ku (JP); Shoji Yamada, Chiyoda-ku (JP); Tomoya Fukui, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 977 days.

(21) Appl. No.: 13/807,457

(22) PCT Filed: Jun. 29, 2010

(86) PCT No.: PCT/JP2010/004285

§ 371 (c)(1),
(2), (4) Date: Mar. 5, 2013

(87) PCT Pub. No.: WO2012/001735

PCT Pub. Date: Jan. 5, 2012

(65) Prior Publication Data

US 2013/0168064 A1 Jul. 4, 2013

(51) Int. Cl.
*F28F 3/12* (2006.01)
*F28F 13/12* (2006.01)
(Continued)

(52) U.S. Cl.
CPC ..... *F28F 13/12* (2013.01); *F24F 1/0011* (2013.01); *F24F 1/0029* (2013.01); *F24F 13/20* (2013.01);
(Continued)

(58) Field of Classification Search
CPC ..... F24F 1/0011; F24F 1/0029; F24F 13/20; F24F 13/24; F24F 1/0033;
(Continued)

(56) References Cited

U.S. PATENT DOCUMENTS 2,275,295 A * 3/1942 Greenway ..... F24F 1/0007 165/109.1
3,403,725 A * 10/1968 Miner ..... F24F 1/0007 165/122
(Continued)

FOREIGN PATENT DOCUMENTS

JP 1-66524 4/1989
JP 5 231706 9/1993
(Continued)

OTHER PUBLICATIONS

JP-06-307660 English Machine Translation.*
(Continued)

*Primary Examiner* — Orlando E Aviles Bosques
*Assistant Examiner* — Jose O Class-Quinones
(74) *Attorney, Agent, or Firm* — Oblon, McClelland, Maier & Neustadt, L.L.P.

(57) ABSTRACT

An air-conditioning apparatus includes a casing having an air inlet and an air outlet and having therein an air passage, and a heat exchanger and an air-sending fan which are arranged in the air passage in the casing. The air passage is divided into a plurality of air passage sections by, for example, a partition. The air-conditioning apparatus can reduce pressure loss in an indoor unit.

13 Claims, 11 Drawing Sheets

(51) Int. Cl.
*F24F 1/00* (2011.01)
*F24F 13/20* (2006.01)
*F24F 13/24* (2006.01)

(52) U.S. Cl.
CPC ..... *F24F 13/24* (2013.01); *F24F 1/0033* (2013.01); *F24F 2001/004* (2013.01); *F24F 2013/247* (2013.01)

(58) Field of Classification Search
CPC ..... F24F 2001/004; F24F 2001/0048; F24F 2001/0037; F24F 2013/247; F24F 1/0059; F24F 1/0014; F24F 1/38; F24F 1/56; F24F 7/065; F28F 13/02; F28F 13/12; F28F 2250/08; F04D 15/0022; F04D 15/0038; F04D 15/0072; F04D 19/002; F04D 19/007; F04D 25/12; F04D 25/166; F04D 27/003; F04D 27/0253; F04D 25/663; F04D 25/667; F04D 25/325; F04D 25/526
USPC ..... 165/47, 48.1, 59, 122, 135, 174, 182
See application file for complete search history.

(56) References Cited

U.S. PATENT DOCUMENTS 4,240,264 A * 12/1980 Nakada ..... F24F 1/0007 165/122
4,876,070 A * 10/1989 Tsukahara ..... A01N 25/34 210/501
4,988,930 A * 1/1991 Oberheide ..... F01P 7/048 318/42
5,343,713 A 9/1994 Okabe et al.
5,547,018 A * 8/1996 Takahashi ..... F24F 1/0011 165/122
5,658,197 A * 8/1997 Kil ..... F24F 1/0011 454/313
5,984,649 A * 11/1999 Kato ..... F24F 1/0007 219/200
6,338,676 B1 1/2002 Kondou et al.
6,378,605 B1 * 4/2002 Kutscher ..... F28B 1/06 165/181
2002/0016149 A1 2/2002 Kondou et al.
2004/0028522 A1 * 2/2004 Lin ..... F04D 25/166 415/66
2007/0097654 A1 * 5/2007 Hao ..... H01L 23/467 361/719
2007/0159796 A1 * 7/2007 Artman ..... H01L 23/3672 361/695
2009/0107167 A1 * 4/2009 Kim ..... F24F 1/0014 62/426

FOREIGN PATENT DOCUMENTS

| | | | | |
|---|---|---|---|---|
| JP | 6-307660 | A | | 11/1994 |
| JP | 8 200780 | | | 8/1996 |
| JP | 9-89344 | A | | 4/1997 |
| JP | 2000 179881 | | | 6/2000 |
| JP | 2000 291976 | | | 10/2000 |
| JP | 2000-329364 | A | | 11/2000 |
| JP | 2001-82396 | A | | 3/2001 |
| JP | 2001-116451 | A | | 4/2001 |
| JP | 2004 53235 | | | 2/2004 |
| JP | 2004-340431 | A | | 12/2004 |
| JP | 2005 3244 | | | 1/2005 |
| JP | 2005003244 | A | * | 1/2005 |
| JP | 2008 45780 | | | 2/2008 |
| WO | 2011/158309 | A1 | | 12/2011 |

OTHER PUBLICATIONS

JP2005003244A—Machine English Translation.pdf.*
JP06307660A—Human English translation.pdf.*
Office Action dated Feb. 24, 2015 in Japanese Patent Application No. 2014-115553 (with English language translation).
Office Action dated Mar. 4, 2014 in the corresponding Japanese patent Application No. 2012-522349 (with English Translation).
Japanese Office Action dated Oct. 1, 2013 in Patent Application No. 2012-522349 with English Translation.
International Search Report dated Aug. 31, 2010 in PCT/JP10/004285 Filed Jun. 29, 2010.
European Search Report issued in Application No. 10854036.0 dated Oct. 4, 2016.

* cited by examiner

AIR-CONDITIONING INDOOR UNIT WITH AXIAL FANS AND HEAT EXCHANGER PARTITION

TECHNICAL FIELD

The present invention relates to an air-conditioning apparatus accommodating an air-sending fan and a heat exchanger in a casing. The present invention further relates to the air-conditioning apparatus further including a sound cancellation unit.

BACKGROUND ART

There have been air-conditioning apparatuses each including an air-sending fan and a heat exchanger in a casing. An air-conditioning apparatus, recently developed as such an air-conditioning apparatus, includes a casing having an air inlet and an air outlet, a heat exchanger placed in the casing, a fan unit including a plurality of small propeller fans arranged across the width of the air inlet and another fan unit including a plurality of small propeller fans arranged across the width of the air outlet such that the fan units are arranged in the air inlet and the air outlet (refer to Patent Literature 1, for example). In this air-conditioning apparatus, the fan unit disposed in the air outlet facilitates control of the direction of air flow and the other fan unit, having the same structure as that of the above fan unit, disposed in the air inlet increases the amount of air to improve the performance of the heat exchanger.

Additionally, there have been air-conditioning apparatuses each including an air-sending fan, a heat exchanger, and a sound cancellation mechanism. Such air-conditioning apparatuses include a recently developed "air-conditioning apparatus including a unit main body having an air inlet, an air outlet, and an air passage extending between the air inlet and the air outlet, a heat exchanger and a fan which are arranged in the air passage, means for generating a standard waveform sound canceling signal having a predetermined frequency and level, a loudspeaker which is positioned so as to face the air passage or near the air outlet and is configured to convert the sound canceling signal into sound, a microphone disposed in a predetermined position in the unit main body, a rotation speed sensor that detects a rotation speed of the fan, and control means for controlling the frequency and level of the sound canceling signal on the basis of the result sensed by the rotation speed sensor and then controlling a phase of the sound canceling signal in accordance with a level of sound detected by the microphone" (refer to Patent Literature 2, for example). This air-conditioning apparatus uses a cross flow fan as an air-sending fan such that the cross flow fan is placed downstream from the heat exchanger. This air-conditioning apparatus further includes a plurality of sound cancellation units (each including the loudspeaker and the microphone) for canceling out sound caused by the cross flow fan. These sound cancellation units are positioned between the cross flow fan and the air outlet such that the units are arranged along the axis of the cross flow fan.

CITATION LIST

Patent Literature

Patent Literature 1: Japanese Unexamined Patent Application Publication No. 2005-3244 (FIGS. 5 and 6)

Patent Literature 2: Japanese Unexamined Patent Application Publication No. 8-200780 (Claim 1, FIG. 2)

SUMMARY OF INVENTION

Technical Problem

In the air-conditioning apparatus disclosed in Patent Literature 1, the air-sending fans are arranged upstream and downstream from the heat exchanger. Specifically, the air-conditioning apparatus disclosed in Patent Literature 1 subjects air, supplied into the casing by the air-sending fans, to heat exchange in the heat exchanger, thereby conditioning the air. In the air-conditioning apparatus disclosed in Patent Literature 1, therefore, swirling flows of the adjacent air-sending fans interfere with each other. Accordingly, in the air-conditioning apparatus disclosed in Patent Literature 1, the disturbance of air flow causes energy loss and non-uniform distribution of air velocity near the heat exchanger. Disadvantageously, in the air-conditioning apparatus disclosed in Patent Literature 1, pressure loss in the air passage in the casing increases, thus resulting in a reduction in performance of the air-conditioning apparatus.

In the air-conditioning apparatus disclosed in Patent Literature 2, sound opposite in phase to sound caused by the air-sending fans is produced by the loudspeakers (or output from the loudspeakers), so that the sound caused by the air-sending fans is cancelled out. At this time, the sound produced by each loudspeaker outwardly radiates from the loudspeaker. Accordingly, in the air-conditioning apparatus disclosed in Patent Literature 2, the sound caused by the air-sending fans and the sound produced by the loudspeakers are in phase in some locations, thus resulting in an increase in sound.

Furthermore, during cooling operation in the air-conditioning apparatus disclosed in Patent Literature 2, the air, which has decreased in temperature while passing through the heat exchanger, passes through the microphones and the loudspeakers. Accordingly, moisture in the air accumulates as condensation on the microphones and the loudspeakers. Unfortunately, the air-conditioning apparatus disclosed in Patent Literature 2 may fail to allow the microphones and loudspeakers to perform an intended operation.

A first object of the present invention is to provide an air-conditioning apparatus which is made to overcome at least one of the above-described disadvantages, which has lower pressure loss in an air passage in a casing than related-art air-conditioning apparatuses, and which is thus capable of improving its performance. Additionally, a second object of the present invention is to provide an air-conditioning apparatus which is made to overcome at least one of the above-described disadvantages and which is capable of enhancing the effect of sound reduction (sound cancellation effect).

Solution to Problem

The present invention provides an air-conditioning apparatus including a casing which has an air inlet and an air outlet and has therein an air passage, and a heat exchanger and an air-sending fan which are arranged in the air passage in the casing, wherein the air-sending fan is an axial flow fan, the air-sending fan is one of a plurality of air-sending fans placed upstream of the heat exchanger, and at least one partition is disposed between the plurality of the air-sending fans to divide the air passage which is interspace of the air-sending fan and the heat exchanger.

The present invention further provides an air-conditioning apparatus including a casing which has an air inlet and an air outlet and has therein an air passage, and a heat exchanger and an air-sending fan which are arranged in the air passage in the casing, a sound cancellation unit which includes at least one sound detection device and a control sound output device outputting control sound, and a control sound producing device which produces the control sound on the basis of at least one result detected by the sound detection device, wherein the sound cancellation unit is one of a plurality of sound cancellation units arranged, wherein the air passage is divided into a plurality of air passage sections by a partition, and wherein at least the control sound output device of the sound cancellation unit is placed in each air passage section.

Advantageous Effects of Invention

In each air-conditioning apparatus according to the present invention, since the air passage is divided, a swirling flow from the air-sending fan can be prevented from interfering with a swirling flow of an air-sending fan adjacent to the air-sending fan. Advantageously, the air-conditioning apparatus according to the present invention can avoid a large eddy caused in the air passage, thereby preventing variations in air velocity near the heat exchanger. In the air-conditioning apparatus according to the present invention, therefore, pressure loss in the air passage in the casing is reduced, so that the performance of the air-conditioning apparatus can be improved.

Furthermore, in each air-conditioning apparatus according to the present invention, since the air passage is divided, sound caused by the air-sending fan can be allowed to be a one-dimensional wave (plane wave) in each air passage section. Additionally, in the air-conditioning apparatus according to the present invention, at least the control sound output device of the sound cancellation unit is placed in each air passage section. Accordingly, sound caused by the air-sending fan is prevented from being in phase with sound produced by a loudspeaker, thus enhancing the sound cancellation effect.

DESCRIPTION OF EMBODIMENTS

Embodiment 1

Figure 1:
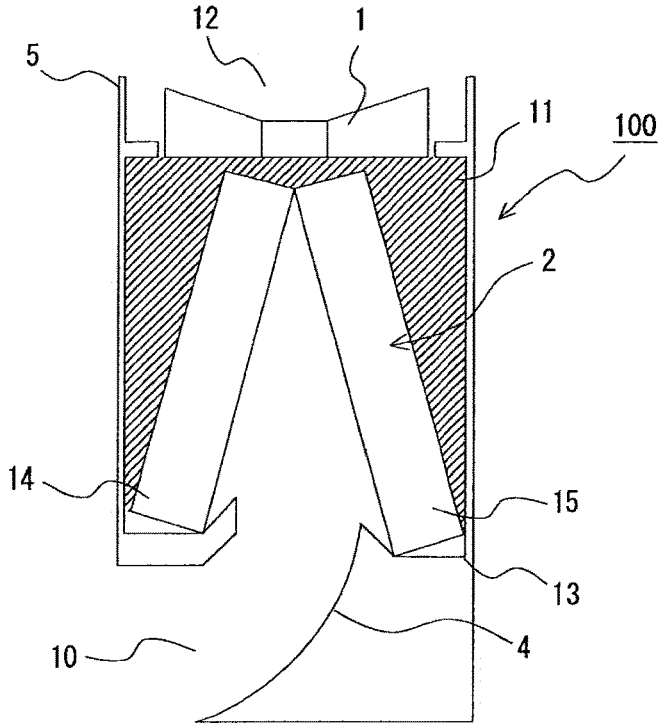
FIG. 1 is a schematic vertical cross-sectional view illustrating an exemplary indoor unit of an air-conditioning apparatus according to Embodiment 1 of the present invention.

FIG. 1 is a schematic vertical cross-sectional view illustrating an exemplary indoor unit of an air-conditioning apparatus according to Embodiment 1 of the present invention. In FIG. 1, a left side surface of the indoor unit, 100, is illustrated as a front surface. The structure of the indoor unit 100 will be described with reference to FIG. 1. This indoor unit 100 is configured to supply conditioned air to an air-conditioned space, such as an indoor space, using a refrigeration cycle through which a refrigerant is circulated. Note that the dimensional relationship among components in FIG. 1 and the following figures may be different from the actual one. A case where the indoor unit 100 is of the wall-mounted type which can be attached to a wall of the air-conditioned space is illustrated as an example.

The indoor unit 100 mainly includes a casing 13 which has an air inlet 12 for entry of indoor air to the inside and an air outlet 10 for supply of conditioned air to the air-conditioned space, an air-sending fan 1 which is accommodated in the casing 13 and is configured to suck the indoor air through the air inlet 12 and blow the conditioned air through the air outlet 10, and a heat exchanger 2 which is disposed in an air passage between the air outlet 10 and the air-sending fan 1 and is configured to exchange heat between the refrigerant and the indoor air in order to produce conditioned air.

The air inlet 12 is positioned on the top of the casing 13. The air outlet 10 is positioned in lower part of the front surface of the casing 13. Accordingly, the air passage through which the air flows from the air inlet 12 to the air outlet 10 is provided in the casing 13. In addition, a nozzle 4 curving toward the air outlet 10 is disposed in the air passage upstream from the air outlet 10 (more specifically, in the air passage between the air outlet 10 and the heat exchanger 2). The air-sending fan 1 is disposed in the air passage in the casing 13. The air-sending fan 1 is, for example, an axial flow fan, a mixed flow fan, or a cross flow fan. In Embodiment 1, the air-sending fan 1 used is an axial flow fan.

The heat exchanger 2 is disposed in the air passage on the leeward side of the air-sending fan 1 and includes a front heat exchanger 14, referred as a first heat exchanger, and a rear heat exchanger 15, referred as a second heat exchanger. As regards this heat exchanger 2, for example, a finned tube heat exchanger may be used. In addition, the air inlet 12 is provided with a finger guard or a filter (not illustrated). Furthermore, the air outlet 10 is provided with a mechanism for controlling the direction of air flow, for example, a vane (not illustrated). The filter may be disposed downstream from the air-sending fan 1.

The flow of air in the indoor unit 100 will now be described in brief.

The air-sending fan 1 allows the indoor air to flow through the air inlet 12, positioned on the top of the casing 13, into the indoor unit 100 (more specifically, the air passage provided in the casing 13). At this time, dust in the air is removed by the filter. While passing through the heat exchanger 2, the indoor air is heated or cooled by the refrigerant flowing through the heat exchanger 2, so as to be conditioned air. The conditioned air is blown from the air outlet 10, positioned in the lower part of the casing 13, to the outside of the indoor unit 100, namely, the air-conditioned space.

The placement of the heat exchanger 2 will now be described.

As illustrated in FIG. 1, the front heat exchanger 14 and the rear heat exchanger 15 constituting the heat exchanger 2 are arranged in the casing 13 such that the interval between the front heat exchanger 14 and the rear heat exchanger 15 increases in the direction of air flow in a vertical cross-section of the indoor unit 100 between the front surface and the rear surface thereof, specifically, the cross-sectional shape of the heat exchanger 2 between the front surface and the rear surface of the indoor unit 100 is substantially inverted V-shaped.

Furthermore, the rear heat exchanger 15 has a longer longitudinal length than the front heat exchanger 14 in the vertical cross-section of the indoor unit 100 between the front surface and the rear surface thereof. Accordingly, a lower edge of the rear heat exchanger 15 is positioned below that of the front heat exchanger 14. Specifically, the heat exchanger 2 in Embodiment 1 is designed such that the amount of air passing through the rear heat exchanger 15 is greater than that through the front heat exchanger 14. Accordingly, when the air passing through the front heat exchanger 14 merges with the air passing through the rear heat exchanger 15, the resultant air flow turns toward the front surface (or the air outlet 10). Consequently, it is unnecessary to sharply deflect the air flow near the air outlet 10. Thus, pressure loss near the air outlet 10 can be reduced. Noise can therefore be reduced.

An internal structure of the indoor unit 100 according to Embodiment 1 will be described in detail below with reference to FIG. 2.

Figure 2:
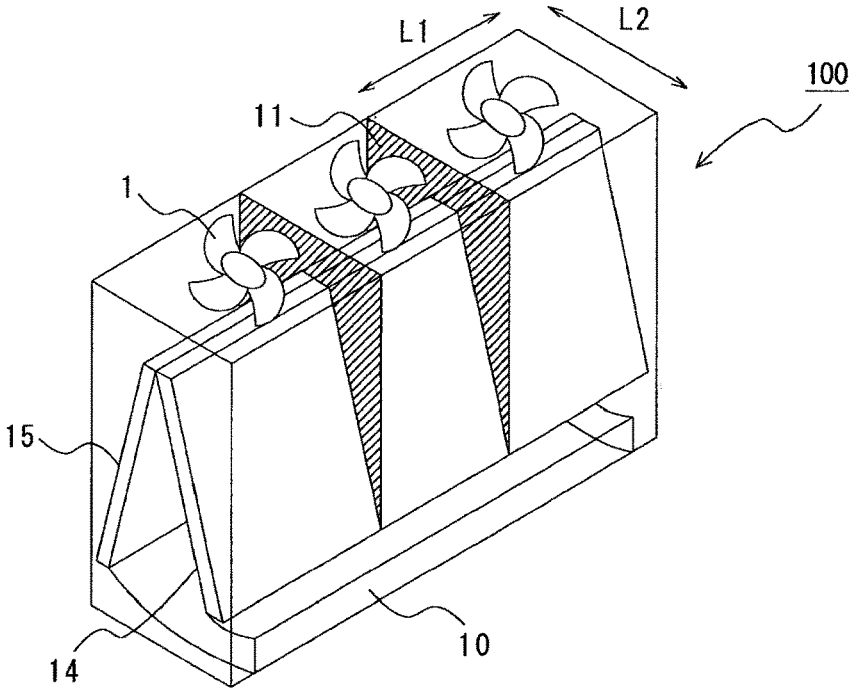
FIG. 2 is a perspective view illustrating an example of the indoor unit of the air-conditioning apparatus according to Embodiment 1 of the present invention.

FIG. 2 is a perspective view illustrating an example of the indoor unit of the air-conditioning apparatus according to Embodiment 1 of the present invention. In FIG. 2, for convenience of understanding, the casing 13 and partitions 11 are illustrated in a transparent manner.

In general, since an installation space for an indoor unit of an air-conditioning apparatus is limited, it is often difficult to increase the size of an air-sending fan. To achieve an intended rate of air flow, therefore, a plurality of air-sending fans having a suitable size are arranged in parallel. In the indoor unit 100 according to Embodiment 1, three air-sending fans 1 are arranged in parallel in the longitudinal direction of the casing 13 as illustrated in FIG. 2.

In addition, a partition 11 is disposed between the adjacent air-sending fans 1. In Embodiment 1, two partitions 11 are arranged. These partitions 11 are positioned interspace of the heat exchanger 2 and the air-sending fans 1. Specifically, the air passage between the heat exchanger 2 and the air-sending fans 1 is divided into a plurality of (in Embodiment 1, three) air passage sections. Since the partitions 11 are arranged between the heat exchanger 2 and the air-sending fans 1, each partition 11 is shaped such that an end thereof adjacent to the heat exchanger 2 fits the heat exchanger 2. More specifically, since the heat exchanger 2 placed is inverted V-shaped, the end of the partition 11 adjacent to the heat exchanger 2 is also inverted V-shaped.

Furthermore, another end of each partition 11 adjacent to the air-sending fans 1 extends up to an outlet plane of the air-sending fans 1, as long as the adjacent air-sending fans 1 are spaced enough to avoid influence on each other on a suction side. In the case where the adjacent air-sending fans 1 are close to each other to such an extent that the air-sending fans 1 affect each other on the suction side and curved part of a bell mouth (not illustrated) disposed on the suction side of each air-sending fan 1 is appropriately shaped, the end of each partition 11 adjacent to the air-sending fans 1 may extend upstream from (on the suction side of) the air-sending fans 1 such that the partition 11 does not affect the adjacent air passage sections (i.e., the adjacent air-sending fans 1 do not affect each other on the suction side). In Embodiment 1, the end of each partition 11 adjacent to the air-sending fans 1 is positioned near the outlet plane of the air-sending fans 1.

The partitions 11 can comprise any of various materials. For example, the partitions 11 may comprise metal, such as steel or aluminum. Alternatively, the partitions 11 may comprise, for example, resin.

In the case where the partitions 11 comprise a low melting point material, such as resin, it is preferred to form a small space between each partition 11 and the heat exchanger 2, because the heat exchanger 2 reaches a high temperature during heating operation. In the case where the partitions 11 comprise a high melting point material, such as aluminum or steel, each partition 11 may be disposed in contact with the heat exchanger 2 or may be placed between fins of the heat exchanger 2.

As described above, the air passage between the heat exchanger 2 and the air-sending fans 1 is divided into the plurality of (in Embodiment 1, three) air passage sections. Each air passage section has a substantially rectangular shape having sides L1 and sides L2 in plan view. In other words, each air passage section has a length L1 and a length L2.

Accordingly, for example, the air sent by each air-sending fan 1 placed within the substantially rectangular section having the sides L1 and L2 in plan view is reliably allowed to pass through the heat exchanger 2 in a region surrounded by the sides L1 and L2 downstream from the air-sending fan 1.

Dividing the interior of the casing 13 using the partitions 11 in this manner prevents swirling components contained in flow formed in the downstream of the air-sending fans 1 from freely moving in the longitudinal direction (direction perpendicular to the drawing sheet of FIG. 1) of the indoor unit 100. Consequently, the air sent by each air-sending fan 1 placed within the substantially rectangular section having the sides L1 and L2 in plan view can be reliably allowed to pass through the heat exchanger 2 disposed downstream from the air-sending fan 1 (or disposed in the region surrounded by the sides L1 and L2). Thus, an air velocity distribution of the air, flowing into the entire heat exchanger 2, in the longitudinal direction (direction perpendicular to the drawing sheet of FIG. 1) of the indoor unit 100 can be substantially uniformed (or variations in velocity of the air, flowing through the heat exchanger 2, across the heat exchanger 2 can be reduced).

In addition, dividing the interior of the casing 13 using the partitions 11 prevents a swirling flow from each air-sending fan 1 (particularly, a swirling flow downstream from the air-sending fan 1) from interfering with a swirling flow from the adjacent air-sending fan 1 (particularly, a swirling flow downstream from the adjacent air-sending fan 1). Consequently, energy loss, such as an eddy, caused by the interference of swirling flows can be avoided. In addition to the improvement of the air velocity distribution, pressure loss in the indoor unit 100 (more specifically, in the air passage in the casing 13) can be reduced.

Additionally, each partition 11 may further have a sound insulation effect of preventing sound caused by each air-sending fan 1 from passing through the partition to the adjacent air passage. To achieve the sound insulation effect, the partition 11 has to have a certain weight. Accordingly, in the case where the partition 11 is formed using, for example, resin having a lower density than metal (e.g., steel or aluminum), it is preferred to increase the thickness of the partition 11.

Furthermore, it is unnecessary to form each partition 11 out of a single plate. The partition 11 may be constituted by a plurality of plates. For example, the partition 11 may include two segments such that one segment is closer to the front heat exchanger 14 and the other segment is closer to the rear heat exchanger 15. So long as there is no clearance at a junction between the segments constituting the partition 11, the same advantages as those obtained in the case where the partition 11 is formed out of a single plate can be offered. Assembling the partition 11 from a plurality of segments facilitates attachment of the partition 11.

Although Embodiment 1 has been described with respect to the indoor unit 100 in which the heat exchanger 2 is disposed in the air passage downstream from the air-sending fan 1, the present invention can, of course, be applied to an indoor unit in which a heat exchanger 2 is disposed upstream from an air-sending fan 1.

Embodiment 2

In Embodiment 1, only the air passage between the air-sending fans 1 and the heat exchanger 2 is divided using the partitions 11. In addition to the air passage between the air-sending fans 1 and the heat exchanger 2, the air passage downstream from the heat exchanger 2 can be divided using partitions. In the following description, the same functions and components as those in Embodiment 1 are designated by the same reference numerals and any item which is not particularly mentioned in Embodiment 2 is the same as that in Embodiment 1.

Figure 3:
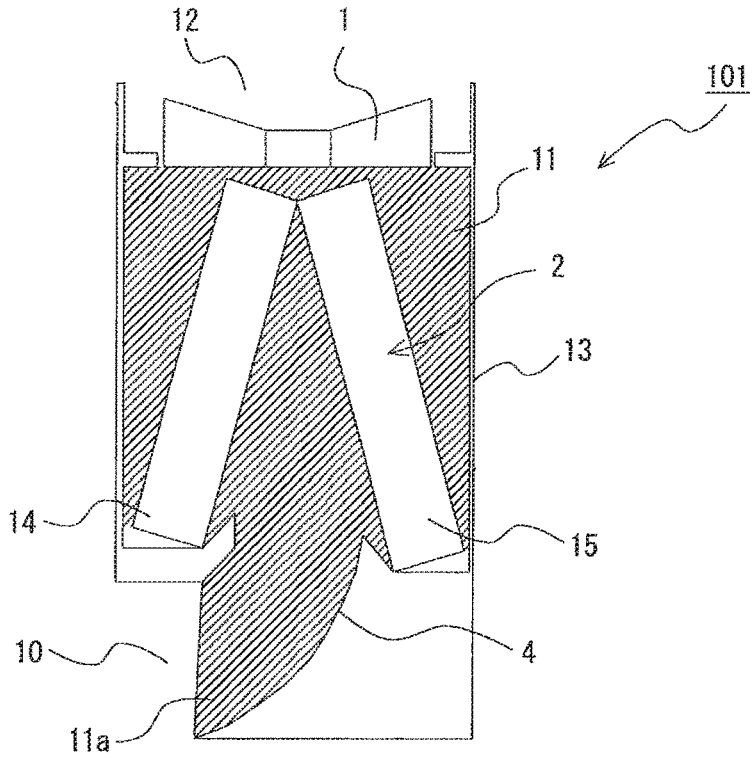
FIG. 3 is a schematic vertical cross-sectional view illustrating an exemplary indoor unit of an air-conditioning apparatus according to Embodiment 2 of the present invention.

FIG. 3 is a schematic vertical cross-sectional view illustrating an exemplary indoor unit of an air-conditioning apparatus according to Embodiment 2 of the present invention.

In the indoor unit, 101, according to Embodiment 2, partitions 11*a* are arranged interspace of a heat exchanger 2 and an air outlet 10. The rest of the structure is the same as that of the indoor unit 100 according to Embodiment 1.

The partitions 11*a* arranged between the heat exchanger 2 and the air outlet 10 are equal in number to partitions 11 arranged between air-sending fans 1 and the heat exchanger 2. Each partition 11*a* is disposed under the corresponding partition 11. More specifically, each partition 11*a* is disposed in substantially parallel to the corresponding partition 11 in plan view. Furthermore, each partition 11*a* is disposed so as to substantially coincide with the corresponding partition 11 in plan view. Consequently, air resistance caused by the arranged partitions 11*a* is reduced.

Since the heat exchanger 2 placed is inverted V-shaped, an end (upper end) of each partition 11*a* adjacent to the heat exchanger 2 is also inverted V-shaped. In this case, the partitions 11*a* are positioned such that the partitions 11*a* are not in contact with the heat exchanger 2. During cooling operation, the heat exchanger 2 reaches a low temperature. Accordingly, moisture in the air accumulates as condensation, such that water droplets adhere to the surface of the heat exchanger 2. If the heat exchanger 2 is in contact with the partitions 11*a*, the water droplets on the surface of the heat exchanger 2 move to the partitions 11*a*. The water droplets, moved to the partitions 11*a*, fall down on the partitions 11 and then reach the air outlet 10, where the water droplets are scattered in the vicinity together with the air blown from the air outlet 10. The scattered water droplets may cause a user to feel discomfort. Such a phenomenon is impermissible in air-conditioning apparatuses. To prevent the water droplets on the surface of the heat exchanger 2 from scattering through the air outlet 10, therefore, the partitions 11*a* are arranged such that the partitions 11*a* are not in contact with the heat exchanger 2.

In the indoor unit 101 with the above-described structure, the arranged partitions 11*a* can reduce the influence of air flow from the adjacent air passage section in an area between the heat exchanger 2 and the air outlet 10. In other words, the arranged partitions 11*a* can prevent a swirling flow from each air-sending fan 1 from interfering with a swirling flow from the adjacent air-sending fan 1 in the area between the heat exchanger 2 and the air outlet 10. Consequently, energy loss, such as an eddy, caused by the interference of swirling flows can be avoided in the area between the heat exchanger 2 and the air outlet 10. In addition, an air velocity distribution of conditioned air, blown from the air outlet 10, in the longitudinal direction (direction perpendicular to the drawing sheet of FIG. 3) of the indoor unit 100 can be substantially uniformed (or variations in velocity of the conditioned air, blown from the air outlet 10, across the air outlet 10 can be reduced). The air-conditioning apparatus (more specifically, the indoor unit) with lower pressure loss can therefore be provided.

Although Embodiment 2 has been described with respect to the case where lower ends of the partitions 11*a* extend up to the air outlet 10, the lower ends of the partitions 11*a* may, of course, be positioned interspace of the heat exchanger 2 and the air outlet 10. The arranged partitions 11*a* allow pressure loss to be lower than that in Embodiment 1.

Embodiment 3

In Embodiment 1 and Embodiment 2, the air-sending fans 1 are equal in number to the air passage sections. Arrangement is not limited to such a pattern. The number of air passage sections may be greater than that of air-sending fans 1. In the following description, the same functions and components as those in Embodiment 1 or Embodiment 2 are designated by the same reference numerals and any item which is not particularly mentioned in Embodiment 3 is the same as that in Embodiment 1 or Embodiment 2.

Figure 4:
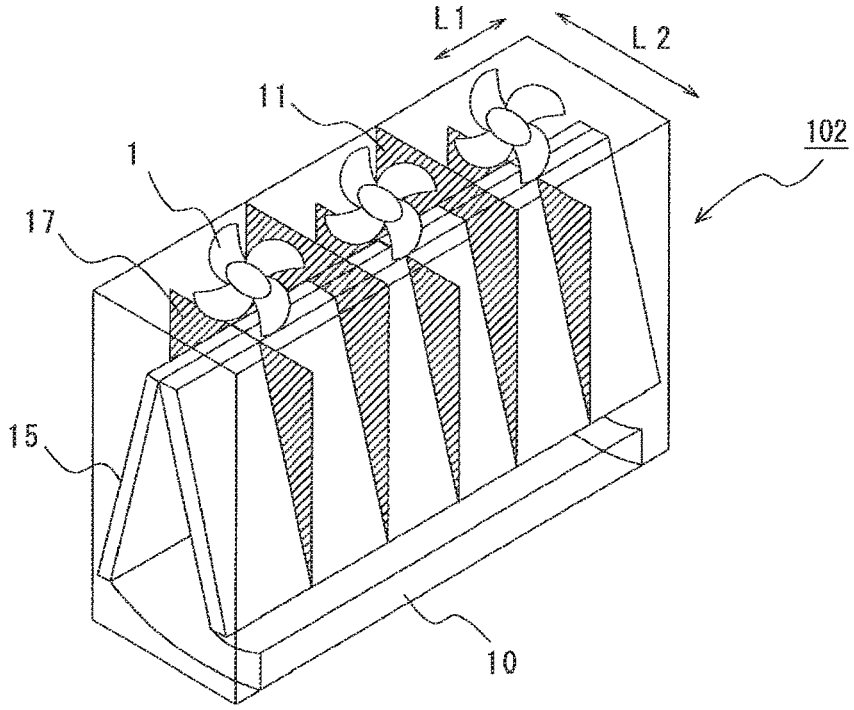
FIG. 4 is a perspective view illustrating an exemplary indoor unit of an air-conditioning apparatus according to Embodiment 3 of the present invention.

FIG. 4 is a perspective view illustrating an exemplary indoor unit of an air-conditioning apparatus according to Embodiment 3 of the present invention. In FIG. 4, for convenience of understanding, a casing 13 and partitions 11 are illustrated in a transparent manner.

In the indoor unit, 102, according to Embodiment 3, each partition 17 is disposed between the partitions 11. Specifically, each air passage section obtained by division in Embodiment 1 is further divided by the partition 17 in Embodiment 3. In other words, substantially half the amount of air flow generated by each air-sending fan 1 flows into a heat exchanger 2 in a region surrounded by L1 and L2. The rest of the structure is the same as that of the indoor unit 100 according to Embodiment 1.

Each partition 17 is positioned so as to substantially equally divide the interval between the adjacent partitions 11. Like the partitions 11, the partitions 17 may comprise any of various materials. For example, the partitions 11 may comprise metal, such as steel or aluminum. Alternatively, the partitions 11 may comprise, for example, resin. The partitions 17 may further have a sound insulation effect, similar to the partitions 11. Accordingly, in the case where the partitions 17 are formed using, for example, resin having a lower density than metal (e.g., steel or aluminum), it is preferred to increase the thickness of each partition 17.

An end of each partition 17 adjacent to the heat exchanger 2 is substantially inverted V-shaped along the heat exchanger 2. In the case where the partition 17 comprises a low melting point material, such as resin, it is preferred to form a small space between the partition 17 and the heat exchanger 2, because the heat exchanger 2 reaches a high temperature during heating operation. In the case where the partition 17 comprises a high melting point material, such as aluminum or steel, the partition 17 may be disposed in contact with the heat exchanger 2 or may be placed between the fins of the heat exchanger 2.

An end of each partition 17 adjacent to the air-sending fans 1 is shaped such that the end is substantially parallel to the outlet plane of the air-sending fans 1. The end of the partition 17 adjacent to the air-sending fans 1 may be mound-shaped such that part of the partition 17 near the center of rotation of the relevant air-sending fan 1 is the highest and the height of the partition 17 becomes lower toward both sides.

The height of the end of each partition 17 adjacent to the air-sending fans 1 may be set as follows.

For example, in the case where the air-sending fans 1 are close to the heat exchanger 2, if the end of each partition 17 adjacent to the air-sending fans 1 is too close to the relevant air-sending fan 1, the partition 17 will resist the flow of air. Accordingly, in the case where each air-sending fan 1 is close to the heat exchanger 2, it is preferred that the distance between the air-sending fan 1 and the end of the partition 17 adjacent to the air-sending fan 1 be longer as much as possible. In the case where the air-sending fan 1 is close to the heat exchanger 2, therefore, the end of the partition 17 adjacent to the air-sending fan 1 may be set at substantially the same level as an upper end (part closest to the air-sending fan 1) of the heat exchanger 2. The end of the partition 17 adjacent to the air-sending fan 1 may, of course, be positioned on each inclined surface of the heat exchanger 2.

Furthermore, for example, in the case where each air-sending fan 1 is at an adequate distance from the heat exchanger 2, each partition 17 does not resist the flow of air. Accordingly, in the case where the air-sending fan 1 is at an adequate distance from the heat exchanger 2, it is preferred that the end of the partition 17 adjacent to the air-sending fan 1 be positioned at a higher level than the upper end (part closest to the air-sending fan 1) of the heat exchanger 2.

In the indoor unit 102 with the above-described structure, the length L1 of each air passage section can be less than that in the indoor unit 100 according to Embodiment 1. Accordingly, the indoor unit 102 according to Embodiment 3 further reduces the degree of freedom in the width direction of a swirling flow caused by each air-sending fan 1 as compared with the indoor unit 100 according to Embodiment 1. The indoor unit 102 according to Embodiment 3 can therefore reduce deterioration of the air velocity distribution more reliably (or uniform the velocity distribution more reliably) than the indoor unit 100 according to Embodiment 1.

Additionally, partitions may be arranged in the air passage between the heat exchanger 2 and the air outlet 10 such that each partition is positioned under the corresponding partition 17 in a manner similar to Embodiment 2. This arrangement can prevent a swirling flow caused by each air-sending fan 1 from interfering with a swirling flow caused by the adjacent air-sending fan 1 in the area between the heat exchanger 2 and the air outlet 10 in a manner similar to Embodiment 2.

Embodiment 4

In Embodiment 3, the partitions 11 extending in the front-to-rear direction of the casing 13 are arranged, and the partitions 17 divide the air passage sections in the casing 13 to increase the number of air passage sections. The partitions 17 are arranged perpendicular to the outlet plane of the air-sending fans 1. The arrangement of the partitions 17, however, is not limited to such a pattern in Embodiment 3. At least upper end parts of the partitions 17 may be arranged at an angle to the outlet plane of the air-sending fans 1. The partitions 17 arranged in that manner can smoothly guide swirling flows caused by the air-sending fans 1 into the heat exchanger 2 on the downstream side. In the following description, the same functions and components as those in Embodiments 1 to 3 are designated by the same reference numerals and any item which is not particularly mentioned in Embodiment 4 is the same as that in Embodiments 1 to 3.

Figure 5:
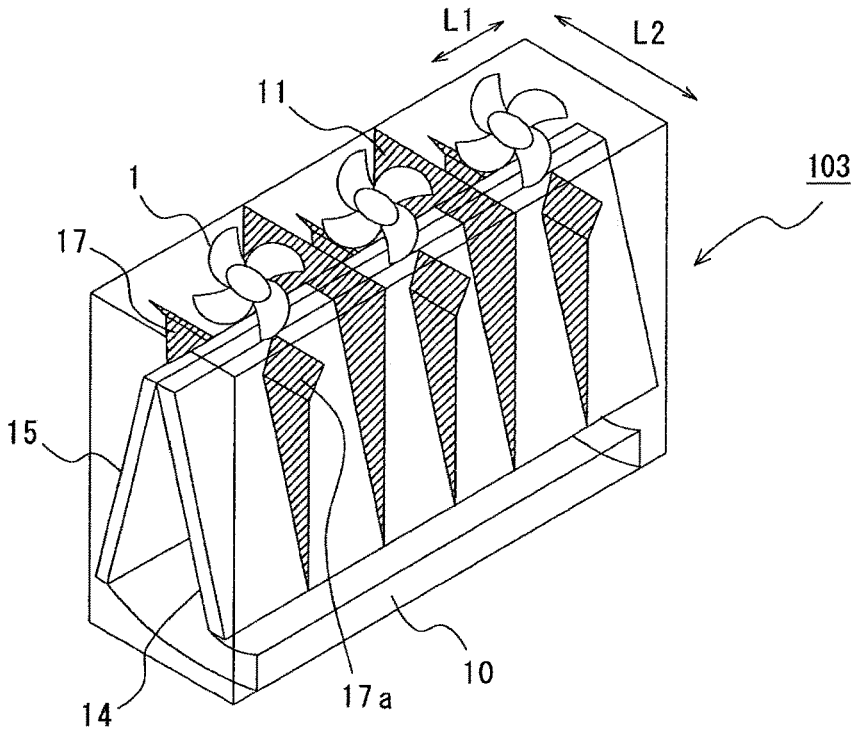
FIG. 5 is a perspective view illustrating an exemplary indoor unit of an air-conditioning apparatus according to Embodiment 4 of the present invention.

FIG. 5 is a perspective view illustrating an exemplary indoor unit of an air-conditioning apparatus according to Embodiment 4 of the present invention. In FIG. 5, for convenience of understanding, a casing 13 and partitions 11 are illustrated in a transparent manner.

The indoor unit, 103, according to Embodiment 4 has the same fundamental structure as that of the indoor unit 102 according to Embodiment 3. The difference between the indoor unit 103 according to Embodiment 4 and the indoor unit 102 according to Embodiment 3 will be described below.

Partitions 17 of the indoor unit 103 according to Embodiment 4 are shaped such that upper end parts 17*a* of each partition 17 are bent. The upper end parts 17*a* of the partitions 17 are arranged so as to incline to the outlet plane of air-sending fans 1. The direction of inclination is identical to the direction of air blown from the air-sending fans 1. In the case where the air-sending fans 1 arranged in the indoor unit 103 are axial flow fans or mixed flow fans, the inclination direction of the upper end parts 17*a* adjacent to the front surface of the indoor unit 103 is opposite to that of the upper end parts 17*a* adjacent to the rear surface thereof, as illustrated in FIG. 5.

The upper end parts 17*a* of the partitions 17 may have a linear shape or curved shape in cross-section. Furthermore, the partitions 17 may be arranged such that not only the upper end parts 17*a* but also the whole of the partitions 17 are inclined to the outlet plane of the air-sending fans 1.

The indoor unit 103 with the above-described structure can smoothly guide swirling flows caused by the air-sending fans 1 into a heat exchanger 2 on the downstream side. This results in a reduction in loss caused by the interference between swirling flows from the air-sending fans 1 and the partitions 17. The indoor unit 103 according to Embodiment 4 can therefore achieve less pressure loss in the air passage than the indoor unit 102 according to Embodiment 3.

Embodiment 5

In Embodiments 1 to 4, the partitions extending in the front-to-rear direction of the casing 13 are arranged to divide the air passage in the casing 13. Additionally, a partition extending in the longitudinal direction of the casing 13 can be placed to further divide the air passage sections in the casing 13. In the following description, the same functions and components as those in Embodiments 1 to 4 are designated by the same reference numerals and any item which is not particularly mentioned in Embodiment 5 is the same as that in Embodiments 1 to 4.

Figure 6:
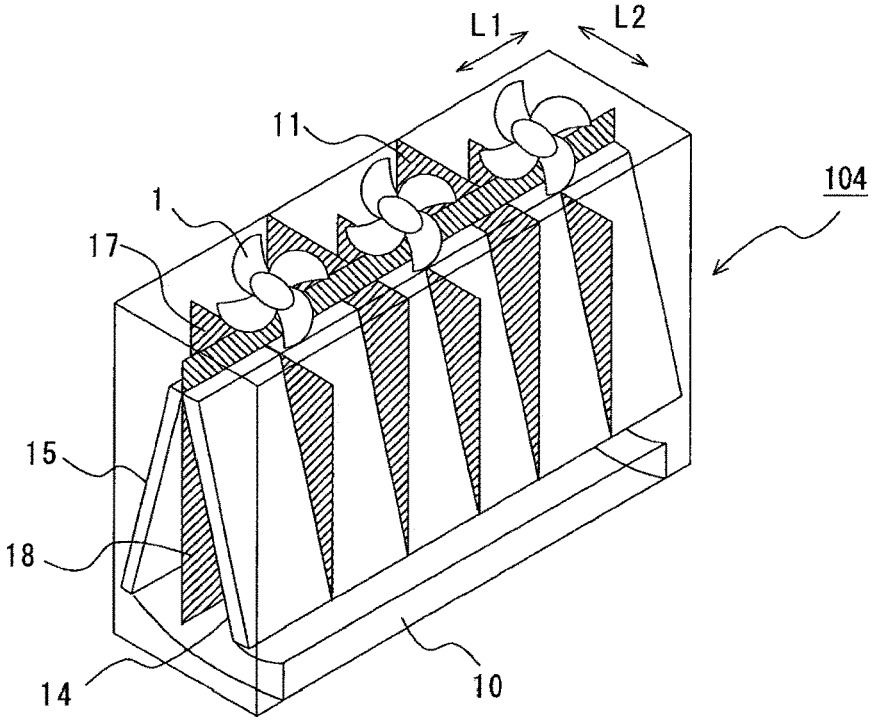
FIG. 6 is a perspective view illustrating an exemplary indoor unit of an air-conditioning apparatus according to Embodiment 5 of the present invention.
Figure 7:
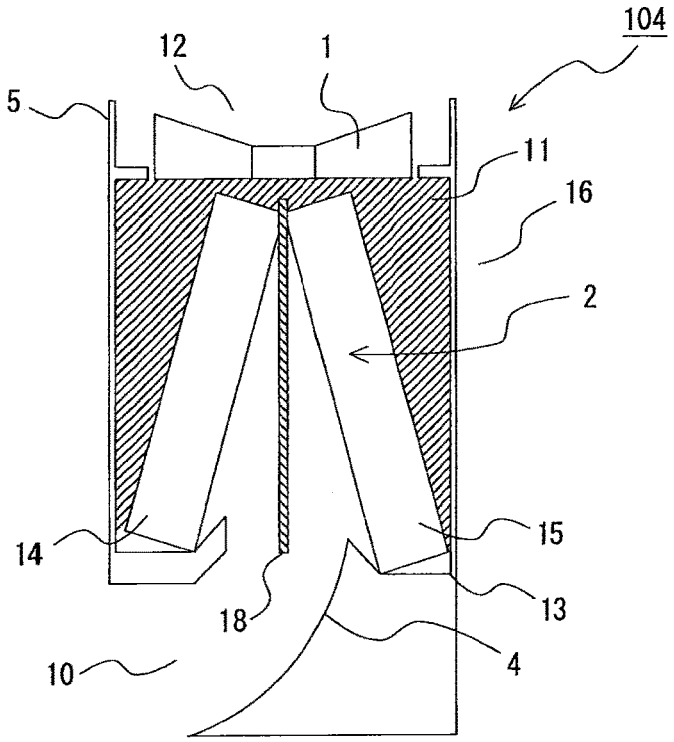
FIG. 7 is a schematic vertical cross-sectional view illustrating an example of the indoor unit of the air-conditioning apparatus according to Embodiment 5 of the present invention.

FIG. 6 is a perspective view illustrating an exemplary indoor unit of an air-conditioning apparatus according to Embodiment 5 of the present invention. FIG. 7 is a schematic vertical cross-sectional view of the indoor unit. In FIG. 6, for convenience of understanding, a casing 13 and partitions 11 are illustrated in a transparent manner.

The indoor unit, 104, according to Embodiment 5 has the same fundamental structure as that of the indoor unit 102 according to Embodiment 3. The difference between the indoor unit 104 according to Embodiment 5 and the indoor unit 102 according to Embodiment 3 will be described below.

The indoor unit 104 according to Embodiment 5 includes a partition 18 that longitudinally divides the air passage sections in the casing 13 in the indoor unit 102 according to Embodiment 3. The partition 18 is disposed between a front heat exchanger 14 and a rear heat exchanger 15 such that the partition 18 intersects at substantially right angles to the partitions 11 and partitions 17. In other words, approximately one fourth of the amount of air flow generated by each air-sending fan 1 flows into a heat exchanger 2 in a region surrounded by L1 and L2.

The position of a lower end of the partition 18 (or the end thereof adjacent to an air outlet 10) may be set as follows.

For example, in the case where the partition 18 is a flat plate as illustrated in FIG. 7, if the lower end of the partition 18 excessively extends downward, the air passage will decrease in area (or the air passage will be blocked by the partition 18), so that the lower end may resist the flow of air. In the case where the partition 18 is a flat plate, therefore, the lower end of the partition 18 is positioned upstream from a nozzle 4.

Figure 8:
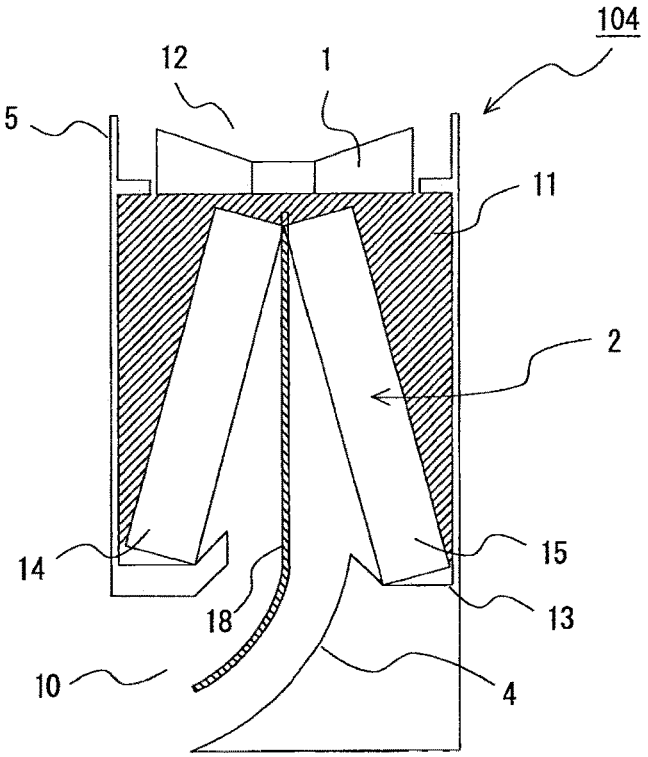
FIG. 8 is a schematic vertical cross-sectional view illustrating another example of the indoor unit of the air-conditioning apparatus according to Embodiment 5 of the present invention.

For example, in the case where the lower end of the partition 18 is curved along the shape of the nozzle 4 as illustrated in FIG. 8, the lower end of the partition 18 may be extended up to the air outlet 10. Extending the lower end of the partition 18 up to the air outlet 10 can reduce fluctuations in air velocity in the nozzle 4 up to the air outlet 10.

In the indoor unit 104 with the above-described structure, the length L2 of each air passage section can be less than that in the indoor units 100 to 103 according to Embodiments 1 to 4. Accordingly, the indoor unit 104 according to Embodiment 5 further reduces the degree of freedom in the width direction of a swirling flow caused by each air-sending fan 1. The indoor unit 104 according to Embodiment 5 can therefore reduce deterioration of the air velocity distribution more reliably (or uniform the velocity distribution more reliably) than the indoor units 100 to 103 according to Embodiments 1 to 4.

Embodiment 6

Each partition described in Embodiments 1 to 5 may be provided with a sound absorbing member, which will be described later, on a surface thereof. Alternatively, the partition may be a sound absorbing member. In the following description, the same functions and components as those in Embodiments 1 to 5 are designated by the same reference numerals and any item which is not particularly mentioned in Embodiment 6 is the same as that in Embodiments 1 to 5.

Figure 9:
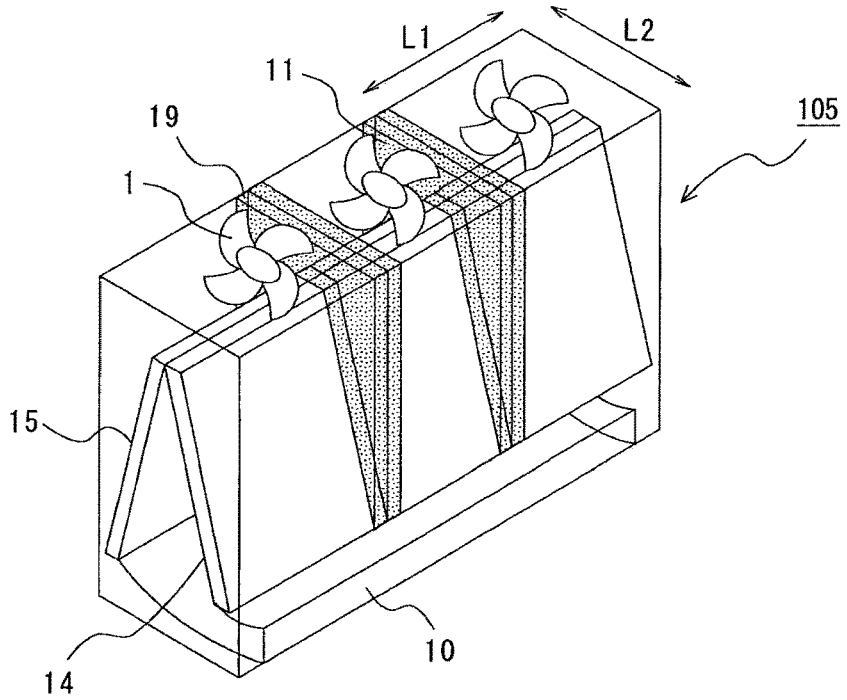
FIG. 9 is a perspective view illustrating an exemplary indoor unit of an air-conditioning apparatus according to Embodiment 6 of the present invention.

FIG. 9 is a perspective view illustrating an exemplary indoor unit of an air-conditioning apparatus according to Embodiment 6 of the present invention. In FIG. 9, for convenience of understanding, a casing 13 and partitions 11 are illustrated in a transparent manner.

The indoor unit, 105, according to Embodiment 6 includes a sound absorbing member 19 on each of both surfaces of each partition 11. Examples of a material of the sound absorbing member 19 include urethane, porous resin, and porous aluminum. Such a sound absorbing member 19 has a small effect in deadening low-frequency sound but can deaden sound with high frequencies at and above 1 kHz. The thicker the sound absorbing member 19 is, the lower frequencies can be absorbed. Additionally, if a sound cancellation unit, which will be described later, is placed, for example, sound at and below 1 kHz can be cancelled out. In this case, the sound absorbing member 19 having a thickness of, for example, 20 mm or less which allows absorption of 2-kHz sound can offer sufficient advantages.

As regards the material of the partitions 11, the partitions 11 may comprise any of various materials in a manner similar to Embodiments 1 to 5. For example, the partitions 11 may comprise metal, such as steel or aluminum. Alternatively, the partitions 11 may comprise, for example, resin. Furthermore, each partition may be a sound absorbing member.

In the indoor unit 105 with the above-described structure, the partitions 11 and similar components can reduce not only the influence of swirling flows caused by air-sending fans 1 but also noise caused by the air-sending fans 1.

Embodiment 7

Embodiments 1 to 6 have been described with respect to the case where the present invention is applied to the indoor unit in which the air-sending fans 1 are arranged upstream from the heat exchanger 2. The present invention is not limited to this case. The present invention can, of course, be applied to an indoor unit in which an air-sending fan 1 is disposed downstream from a heat exchanger 2. In the following description, the same functions and components as those in Embodiments 1 to 6 are designated by the same reference numerals and any item which is not particularly mentioned in Embodiment 7 is the same as that in Embodiments 1 to 6.

Figure 10:
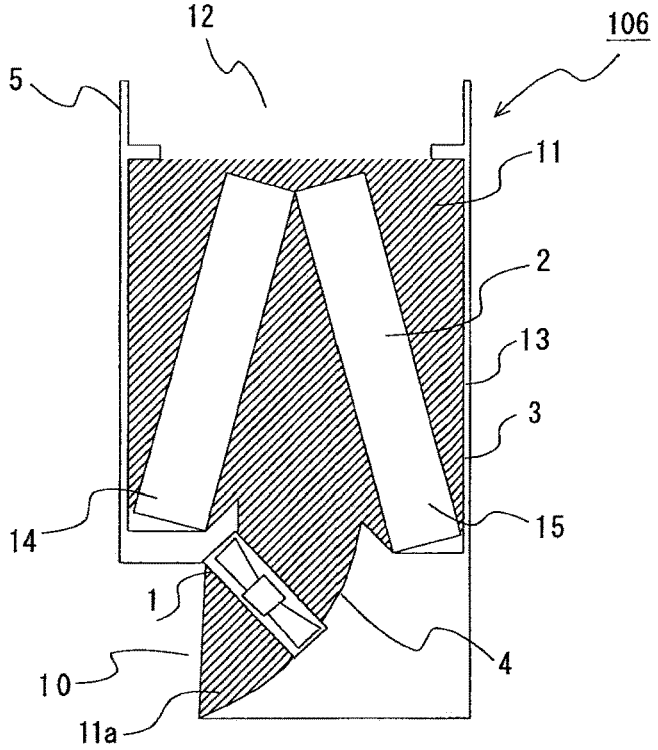
FIG. 10 is a schematic vertical cross-sectional view illustrating an exemplary indoor unit of an air-conditioning apparatus according to Embodiment 7 of the present invention.

FIG. 10 is a schematic vertical cross-sectional view illustrating an exemplary indoor unit of an air-conditioning apparatus according to Embodiment 6 of the present invention.

Figure 11:
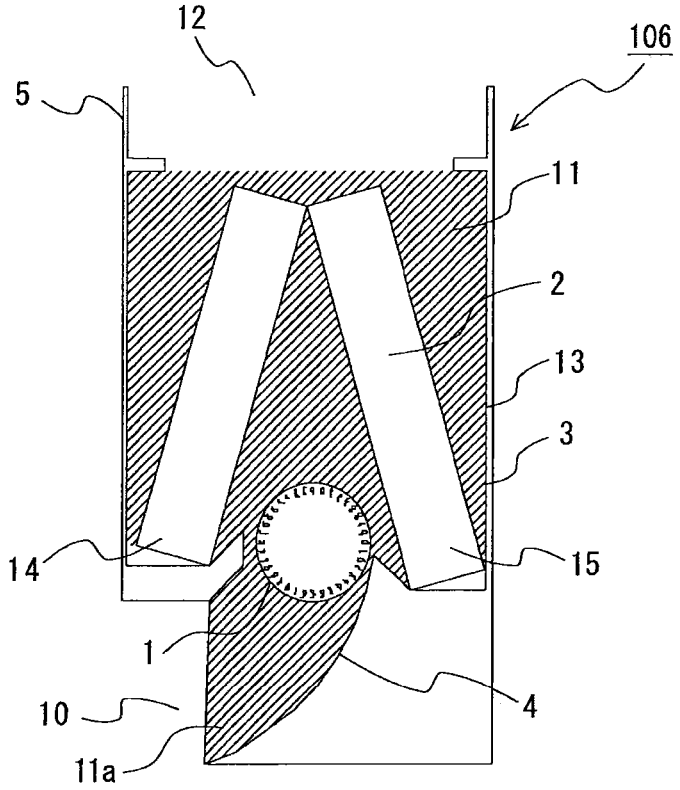
FIG. 11 is a schematic vertical cross-sectional view illustrating an example of the indoor unit of the air-conditioning apparatus according to Embodiment 7 of the present invention.

In the indoor unit, 106, according to Embodiment 7, an air-sending fan 1 is disposed downstream from a heat exchanger 2. Furthermore, the air-sending fan 1 used is an axial flow fan. Alternatively, the air-sending fan 1 may be a cross flow fan. FIG. 11 illustrates a case where the cross flow fan is used.

In addition, an air passage provided in a casing 13 is divided in a manner similar to Embodiment 2. Specifically, an air passage between an air inlet 12 and the heat exchanger 2 is divided by a partition 11. An air passage between the heat exchanger 2 and an air outlet 10 is divided by a partition 11*a*.

An end of the partition 11 adjacent to the heat exchanger 2 is substantially inverted V-shaped along the heat exchanger 2. In the case where the partition 11 comprises a low melting point material, such as resin, it is preferred to form a small space between the partition 11 and the heat exchanger 2, because the heat exchanger 2 reaches a high temperature during heating operation. In the case where the partition 11 comprises a high melting point material, such as aluminum or steel, the partition 11 may be disposed in contact with the heat exchanger 2, or the partition 11 may be positioned between fins of the heat exchanger 2.

An end of the partition 11*a* adjacent to the heat exchanger 2 is also inverted V-shaped. In this case, to prevent water droplets on the surface of the heat exchanger 2 from scattering through the air outlet 10, the partition 11*a* is disposed such that the partition 11*a* is not in contact with the heat exchanger 2.

Additionally, each of the partition 11 and the partition 11*a* may be constituted by a plurality of segments to facilitate attachment of the partitions 11 and 11*a*.

As described above, in the indoor unit 105 in which the air-sending fan 1 is disposed downstream from the heat exchanger 2, the air velocity distribution in the longitudinal direction (direction perpendicular to the drawing sheet of FIG. 10) of the indoor unit 105 can be substantially uniformed (or the air velocity distribution can be improved).

Embodiment 8

In the air-conditioning apparatus (more specifically, the indoor unit in the air-conditioning apparatus) in which the air passage in the casing 13 is divided into a plurality of sections as described above, the following sound cancellation unit can cancel out sound (noise) caused by the air-sending fan or fans 1 more effectively than related art.

Figure 12:
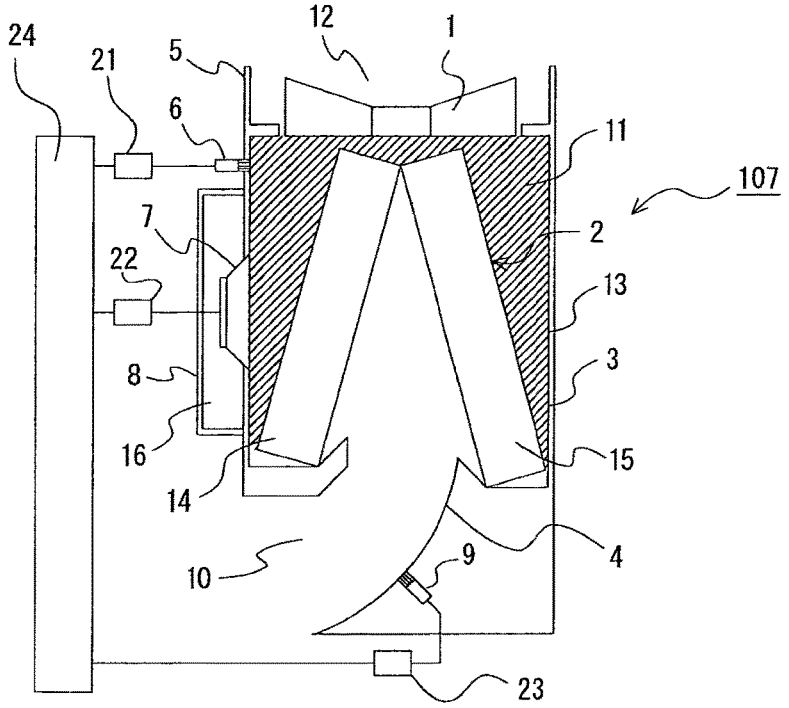
FIG. 12 is a schematic vertical cross-sectional view illustrating an exemplary indoor unit of an air-conditioning apparatus according to Embodiment 8 of the present invention.

FIG. 12 is a schematic vertical cross-sectional view illustrating an exemplary indoor unit of an air-conditioning apparatus according to Embodiment 8 of the present invention. In FIG. 12, a left side surface of the indoor unit, 107, is illustrated as a front surface. The structure of the indoor unit 107, in particular, the placement of a sound cancellation unit will be described with reference to FIG. 12. The indoor unit 107 is configured to supply conditioned air to a conditioned space, such as an indoor space, using a refrigeration cycle through which a refrigerant is circulated. Note that the dimensional relationship among components in FIG. 12 and the following figures may be different from the actual one. A case where the indoor unit 107 is of the wall-mounted type which can be attached to a wall of the air-conditioned space is illustrated as an example.

The indoor unit 107 mainly includes a casing 13 which has an air inlet 12 for entry of indoor air to the inside and an air outlet 10 for supply of conditioned air to the air-conditioned space, an air-sending fan 1 which is accommodated in the casing 13 and is configured to suck the indoor air through the air inlet 12 and blow the conditioned air through the air outlet 10, and a heat exchanger 2 which is disposed in an air passage between the air outlet 10 and the air-sending fan 1 and is configured to exchange heat between the refrigerant and the indoor air in order to produce conditioned air.

The air inlet 12 is positioned on the top of the casing 13. The air outlet 10 is positioned in lower part of the front surface of the casing 13. Accordingly, the air passage through which the air flows from the air inlet 12 to the air outlet 10 is provided in the casing 13. In addition, a nozzle 4 curving toward the air outlet 10 is disposed in the air passage upstream from the air outlet 10 (more specifically, in the air passage between the air outlet 10 and the heat exchanger 2). The air-sending fan 1 is disposed in the air passage in the casing 13. The air-sending fan 1 is, for example, an axial flow fan, a mixed flow fan, or a cross flow fan. In Embodiment 8, the air-sending fan 1 used is an axial flow fan.

The heat exchanger 2 is disposed in the air passage on the leeward side of the air-sending fan 1 and includes a front heat exchanger 14, referred as a first heat exchanger, and a rear heat exchanger 15, referred as a second heat exchanger. As regards this heat exchanger 2, for example, a finned tube heat exchanger may be used. In addition, the air inlet 12 is provided with a finger guard or a filter (not illustrated). Furthermore, the air outlet 10 is provided with a mechanism for controlling the direction of air flow, for example, a vane (not illustrated).

The flow of air in the indoor unit 107 will now be described in brief.

The air-sending fan 1 allows the indoor air to flow through the air inlet 12, positioned on the top of the casing 13, into the indoor unit 107 (more specifically, the air passage provided in the casing 13). At this time, dust in the air is removed by the filter. While passing through the heat exchanger 2, the indoor air is heated or cooled by the refrigerant flowing through the heat exchanger 2, thereby producing conditioned air. The conditioned air is blown through the air outlet 10 positioned in the lower part of the casing 13 to the outside of the indoor unit 107, namely, the air-conditioned space.

The placement of the heat exchanger 2 will now be described.

As illustrated in FIG. 12, the front heat exchanger 14 and the rear heat exchanger 15 constituting the heat exchanger 2 are arranged in the casing 13 such that the interval between the front heat exchanger 14 and the rear heat exchanger 15 increases in the direction of air flow in a vertical cross-section of the indoor unit 107 between the front surface and the rear surface thereof, specifically, the cross-sectional shape of the heat exchanger 2 between the front surface and the rear surface of the indoor unit 107 is substantially inverted V-shaped.

Furthermore, the rear heat exchanger 15 has a longer longitudinal length than the front heat exchanger 14 in the vertical cross-section of the indoor unit 107 between the front surface and the rear surface thereof. Accordingly, a lower edge of the rear heat exchanger 15 is positioned below that of the front heat exchanger 14. Specifically, the heat exchanger 2 according to Embodiment 8 is designed such that the amount of air passing through the rear heat exchanger 15 is greater than that through the front heat exchanger 14. Accordingly, when the air passing through the front heat exchanger 14 merges with the air passing through the rear heat exchanger 15, the resultant air flow turns toward the front surface (or the air outlet 10). Consequently, it is unnecessary to sharply deflect the air flow near the air outlet 10. Thus, pressure loss near the air outlet 10 can be reduced. Noise can therefore be reduced.

The indoor unit 107 according to Embodiment 8 further includes a sound cancellation unit. The sound cancellation unit according to Embodiment 8 includes a microphone 6, a control loudspeaker 7, and a microphone 9.

A method of sound cancellation used in Embodiment 8 will now be described below. Then, the components of the sound cancellation unit according to Embodiment 8 will be described with respect to, for example, functions and positions of the components.

The method of sound cancellation used in Embodiment 8 is a sound cancellation method generally called active noise control. In brief, according to this sound cancellation method, sound opposite in phase to sound caused by a noise source is output from a loudspeaker in a path through which the sound caused by the noise source propagates. The sound caused by the noise source is cancelled out or reduced using Huygens' principle (principle of superposition of waves).

Components necessary for the sound cancellation method, called active noise control, vary depending on control process. Typical control processes for active noise control include two types, feedforward control and feedback control.

Feedforward control is a control process including detecting sound from a noise source and outputting (radiating) control sound generated on the basis of the result of detection. The feedforward control uses a microphone (corresponding to the microphone 6 in Embodiment 8) for detecting sound from a noise source, a loudspeaker (corresponding to the control loudspeaker 7 in Embodiment 8) for outputting control sound generated on the basis of the sound detected by the microphone, and a microphone (corresponding to the microphone 9 in Embodiment 8), disposed in a region intended to be quiet (hereinafter, referred to as a "quiet zone"), for detecting sound in the quiet zone.

Feedback control is a control process including outputting control sound, generated on the basis of sound detected by a microphone (corresponding to the microphone 9 in Embodiment 8) for detecting sound in a quiet zone, from a loudspeaker (corresponding to the control loudspeaker 7 in Embodiment 8) without using a microphone (corresponding to the microphone 6 in Embodiment 8) for detecting sound from a noise source. The feedback control uses, for example, a microphone (corresponding to the microphone 9 in Embodiment 8) for detecting sound in a quiet zone and a loudspeaker (corresponding to the control loudspeaker 7 in Embodiment 8) for outputting control sound generated on the basis of the sound detected by the microphone.

As illustrated in FIG. 12, the indoor unit 107 according to Embodiment 8 cancels out or reduces sound caused by the air-sending fan 1 in a feedforward control manner.

More specifically, the microphone 6 for detecting sound from a noise source is placed near the air-sending fan 1, serving as a sound source. In Embodiment 8, the microphone 6 is placed on the front surface of the casing 13.

The control loudspeaker 7 for outputting control sound is disposed in the air passage downstream from the microphone 6. In Embodiment 8, the control loudspeaker 7 is placed on the front surface of the casing 13. In this case, the control loudspeaker 7 is disposed so as to be exposed to air in the air passage such that sound output from the control loudspeaker 7 can radiate in the air passage. In addition, the rear of the control loudspeaker 7 (or the opposite side thereof from the air passage) is covered with a box 8. A space in the box 8 serves as a back chamber 16 necessary for generation of low-frequency sound.

The microphone 9 for detecting sound in a quiet zone is disposed near the air outlet 10 that is the quiet zone.

The microphone 6 and the microphone 9 correspond to sound detecting devices in the present invention. Furthermore, the control loudspeaker 7 corresponds to a control sound output device in the present invention.

In the case where sound caused by the air-sending fan 1 is cancelled out or reduced in a feedback control manner, the microphone 6 is not needed as described above. In this case, the sound cancellation unit is constituted by the control loudspeaker 7 and the microphone 9.

Each of the microphones (microphones 6 and 9) and the control loudspeaker 7 is connected to an amplifier. An amplifier 21, connected to the microphone 6, amplifies an electrical signal output from the microphone 6 (or an electrical signal corresponding to sound detected by the microphone 6). An amplifier 23, connected to the microphone 9, amplifies an electrical signal output from the microphone 9 (or an electrical signal corresponding to sound detected by the microphone 9). An amplifier 22, connected to the control loudspeaker 7, amplifies an electrical signal to be output to the control loudspeaker 7 (or an electrical signal corresponding to control sound to be output from the control loudspeaker 7).

These amplifiers 21 to 23 are connected to a controller 24 which includes a DSP (Digital Signal Processor) and a control circuit. The controller 24 processes electrical signals (corresponding to sound detected by the microphones 6 and 9) supplied from the amplifiers 21 and 23 and generates an electrical signal (corresponding to control sound to be output from the control loudspeaker 7) to be output to the amplifier 22.

The amplifiers 21 to 23 and the controller 24 correspond to a control sound generating device in the present invention.

An internal structure of the indoor unit 107 according to Embodiment 8 and a position of the sound cancellation unit will now be described in more detail with reference to FIG. 13.

Figure 13:
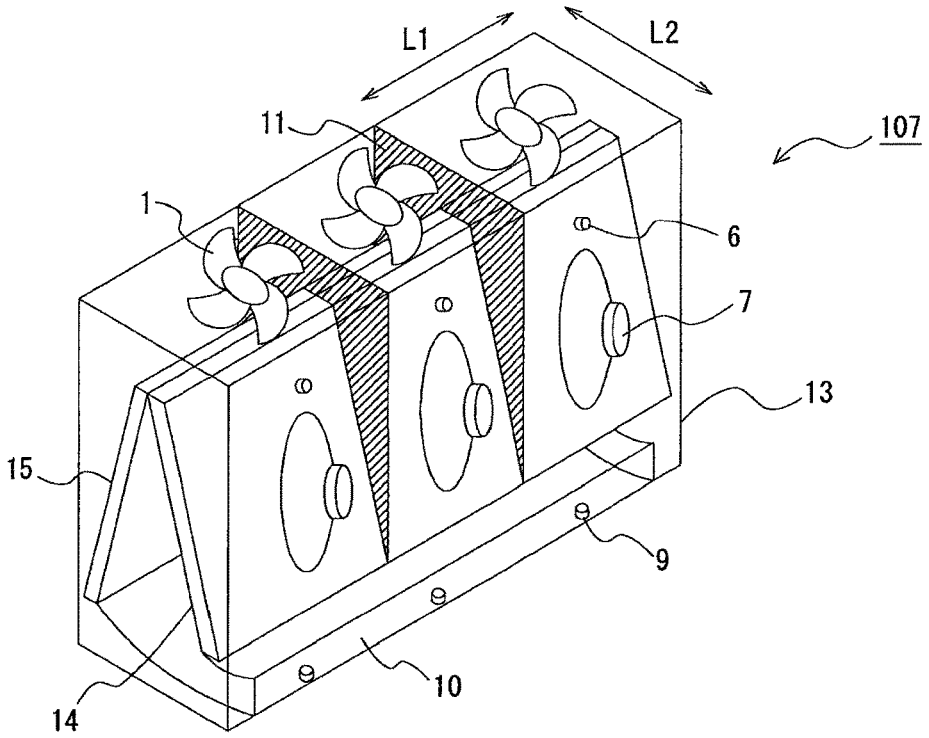
FIG. 13 is a perspective view illustrating an example of the indoor unit of the air-conditioning apparatus according to Embodiment 8 of the present invention.

FIG. 13 is a perspective view illustrating an example of the indoor unit of the air-conditioning apparatus according to Embodiment 8 of the present invention. In FIG. 13, for convenience of understanding, the casing 13 and partitions 11 are illustrated in a transparent manner and the box 8 (the back chamber 16), the amplifiers 21 to 23, the controller 24, and the like are not illustrated in FIG. 13.

In general, since an installation space for an indoor unit of an air-conditioning apparatus is limited, it is often difficult to increase the size of an air-sending fan. To achieve an intended rate of air flow, therefore, a plurality of air-sending fans having a suitable size are arranged in parallel. In the indoor unit 107 according to Embodiment 8, three air-sending fans 1 are arranged in parallel in the longitudinal direction of the casing 13 as illustrated in FIG. 13.

In addition, a partition 11 is disposed between the adjacent air-sending fans 1. In Embodiment 8, two partitions 11 are arranged. These partitions 11 are arranged between the heat exchanger 2 and the air-sending fans 1. Specifically, the air passage between the heat exchanger 2 and the air-sending fans 1 is divided into a plurality of (in Embodiment 8, three) air passage sections. Since the partitions 11 are arranged between the heat exchanger 2 and the air-sending fans 1, each partition 11 is shaped such that an end thereof adjacent to the heat exchanger 2 fits the heat exchanger 2. More specifically, since the heat exchanger 2 placed is inverted V-shaped, the end of the partition 11 adjacent to the heat exchanger 2 is also inverted V-shaped. Furthermore, an end of the partition 11 adjacent to the air-sending fans 1 is shaped in consideration of, for example, the shape of the air inlet 12 and that of the air-sending fans 1 to allow little or no leakage of air and sound to the adjacent air passage section. In Embodiment 8, the end of the partition 11 adjacent to the air-sending fans 1 is positioned near the air-sending fans 1.

The partitions 11 may comprise any of various materials. For example, the partitions 11 may comprise metal, such as steel or aluminum. Alternatively, the partitions 11 may comprise, for example, resin.

In the case where the partitions 11 comprise a low melting point material, such as resin, it is preferred to form a small space between each partition 11 and the heat exchanger 2, because the heat exchanger 2 reaches a high temperature during heating operation. In the case where the partitions 11 comprise a high melting point material, such as aluminum or steel, each partition 11 may be disposed in contact with the heat exchanger 2 or may be placed between fins of the heat exchanger 2.

In addition, the microphone 6 and the control loudspeaker 7 are arranged in each of the air passage sections separated by the partitions 11.

As described above, the air passage between the heat exchanger 2 and the air-sending fans 1 is divided into the plurality of (in Embodiment 8, three) air passage sections. Each air passage section has a substantially rectangular shape having sides L1 and sides L2 in plan view. In other words, each air passage section has a length L1 and a length L2.

Accordingly, for example, assuming that L1<L2, when sound caused by each air-sending fan 1 passes through the corresponding air passage section, a sound wave with frequency f whose half-wave length is less than L1 propagates as a plane wave (one-dimensional wave). Alternatively, for example, assuming that L1>L2, when sound caused by each air-sending fan 1 passes through the corresponding air passage section, a sound wave with frequency f whose half-wave length is less than L2 propagates as a plane wave (one-dimensional wave).

The above-described division of the air passage in the casing 13 with the partitions 11 enables a sound wave with a frequency whose half-wave length is less than the length of a shorter side of each air passage section to be a plane wave (one-dimensional wave). In addition, as the number of air passage sections in the casing 13 is increased, a sound wave with a higher frequency can be allowed to be a plane wave (one-dimensional wave).

The frequency f for plane wave generation (one-dimensional wave generation) is expressed as follows:

$$f<c/(2*L)$$

where c denotes the sound velocity. In addition, L denotes a value of the shorter length of L1 and L2.

The plane sound wave in the sound caused by each air-sending fan 1 is detected by the microphone 6 disposed in the corresponding air passage section and is cancelled out by an opposite-phase sound wave output from the control loudspeaker 7 disposed in the air passage section. At this time, the plane sound wave is susceptible to the effect of sound cancellation due to superposition, so that the plane sound wave is effectively cancelled out.

On the other hand, sound waves which are not plane waves are repeatedly reflected in the air passage sections in the casing 13 and propagate up to the air outlet 10. The sound waves which are not plane waves are not significantly susceptible to the sound cancellation effect in the active noise control for sound cancellation due to sound wave superposition, because the nodes and antinodes of such sound waves are randomly present in the air passage sections in the casing 13.

In the indoor unit 107 with the above-described structure, since the air passage in the casing 13 is divided into air passage sections by the partitions 11 and the control loudspeaker 7 is provided for each air passage section, the sound cancellation effect can be derived at higher frequency than that in related art. Furthermore, as the number of air passage sections in the casing 13 is increased, the sound cancellation effect can be derived at higher frequency.

Each partition 11 further has a sound insulation effect of preventing sound caused by each air-sending fan 1 from passing through the partition to the adjacent air passage section. If the plane sound wave partially enters the adjacent air passage section, a sound wave having the same frequency as that of the entered sound wave will not be a plane wave in the air passage section in which the sound wave has entered, thus reducing the sound cancellation effect. To achieve the sound insulation effect, the partition 11 has to have a certain weight. Accordingly, in the case where the partition 11 is formed using, for example, resin having a lower density than metal (e.g., steel or aluminum), it is preferred to increase the thickness of the partition 11.

Each partition 11 further has an effect of enhancing the efficiency of the air-sending fans 1. The reason is that since the flows of air blown from the adjacent air-sending fans 1 can be prevented from interfering with each other on the downstream side, energy loss caused in each air-sending fan 1 due to the interference can be avoided.

The microphone 6 and the control loudspeaker 7 of the sound cancellation unit are arranged in each air passage section upstream from the heat exchanger 2. Accordingly, air which has decreased in temperature while passing through the heat exchanger 2 during cooling operation can be prevented from passing through the microphone 6 and the control loudspeaker 7. Consequently, condensation on the microphone 6 and the control loudspeaker 7 can be avoided, thereby increasing the reliability of the microphone 6 and that of the control loudspeaker 7.

Furthermore, it is unnecessary to form each partition 11 out of a single plate. The partition 11 may be constituted by a plurality of plates. For example, the partition 11 may include two segments such that one segment is closer to the front heat exchanger 14 and the other segment is closer to the rear heat exchanger 15. So long as there is no clearance at a junction between the segments constituting the partition 11, the same sound cancellation effect as that obtained in the case where the partition 11 is formed out of a single plate can be achieved. Assembling the partition 11 from a plurality of segments facilitates attachment of the partition 11.

Furthermore, although the microphone 6 and the control loudspeaker 7 are arranged on the front surface of the casing 13 in the indoor unit 107 according to Embodiment 8, at least one of the microphone 6 and the control loudspeaker 7 may, of course, be disposed on the rear surface of the casing 13.

Additionally, although Embodiment 8 has been described with respect to the indoor unit 107 in which the heat exchanger 2 is placed in the air passage downstream from the air-sending fans 1, the present invention may, of course, be applied to an indoor unit in which a heat exchanger 2 is placed upstream from an air-sending fan 1. Specifically, the air passage between the air-sending fan 1 and the air outlet may be divided into air passage sections by a partition 11 and a microphone 6 and a control loudspeaker 7 may be arranged in each air passage section. In the case where sound caused by the air-sending fan 1 is cancelled out in a feedback control manner, only the control loudspeaker 7 may be disposed in the air passage section.

Embodiment 9

In Embodiment 8, only the air passage between the air-sending fans 1 and the heat exchanger 2 is divided by the partitions 11. In addition to the air passage between the air-sending fans 1 and the heat exchanger 2, the air passage downstream from the heat exchanger 2 can be divided using partitions. In the following description, the same functions and components as those in Embodiment 8 are designated by the same reference numerals and any item which is not particularly mentioned in Embodiment 9 is the same as that in Embodiment 8.

Figure 14:
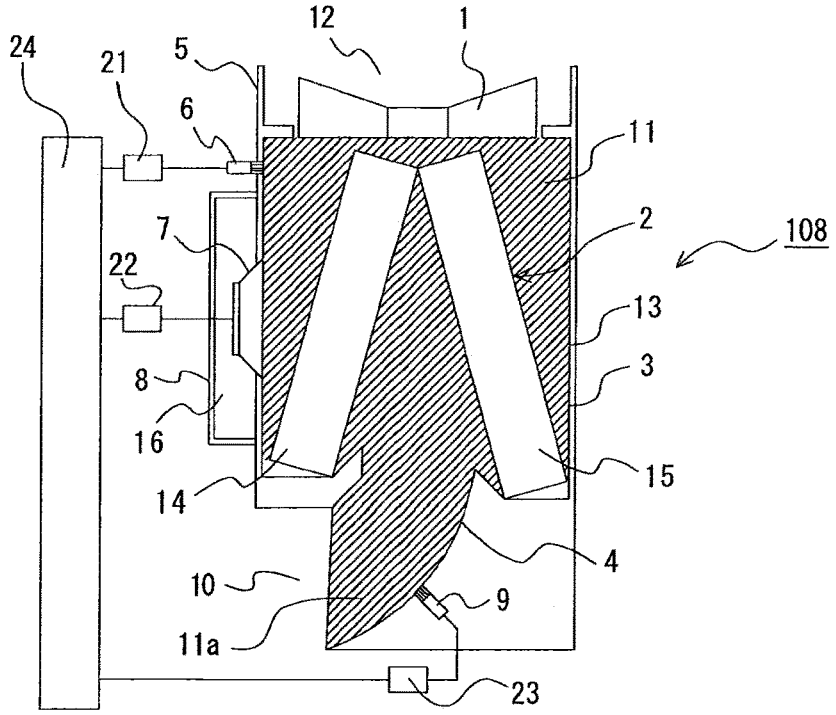
FIG. 14 is a schematic vertical cross-sectional view illustrating an exemplary indoor unit of an air-conditioning apparatus according to Embodiment 9 of the present invention.

FIG. 14 is a schematic vertical cross-sectional view illustrating an exemplary indoor unit of an air-conditioning apparatus according to Embodiment 9 of the present invention.

In the indoor unit, 108, according to Embodiment 9, partitions 11*a* are arranged between a heat exchanger 2 and an air outlet 10. The rest of the structure is the same as that of the indoor unit 107 according to Embodiment 8.

The partitions 11*a* arranged between the heat exchanger 2 and the air outlet 10 are equal in number to partitions 11 arranged between the heat exchanger 2 and air-sending fans 1. Each partition 11*a* is disposed under the corresponding partition 11. More specifically, each partition 11*a* is disposed in substantially parallel to the corresponding partition 11 in plan view. In addition, each partition 11*a* is disposed so as to substantially coincide with the corresponding partition 11 in plan view. Consequently, air resistance caused by the arranged partitions 11*a* is reduced.

Since the heat exchanger 2 placed is inverted V-shaped, an end (upper end) of each partition 11*a* adjacent to the heat exchanger 2 is also inverted V-shaped. In this case, the partition 11*a* is positioned such that the partition 11*a* is not in contact with the heat exchanger 2. During cooling operation, the heat exchanger 2 reaches a low temperature. Accordingly, moisture in the air accumulates as condensation, such that water droplets adhere to the surface of the heat exchanger 2. If the heat exchanger 2 is in contact with the partitions 11*a*, the water droplets on the surface of the heat exchanger 2 move to the partitions 11*a*. The water droplets, moved to the partitions 11*a*, fall down on the partitions 11 and then reach the air outlet 10, where the water droplets are scattered in the vicinity together with the air blown from the air outlet 10. The scattered water droplets may cause a user to feel discomfort. Such a phenomenon is impermissible in air-conditioning apparatuses. To prevent the water droplets on the surface of the heat exchanger 2 from scattering through the air outlet 10, therefore, the partitions 11*a* are arranged such that the partitions 11*a* are not in contact with the heat exchanger 2.

In the indoor unit 108 with the above-described structure, the arranged partitions 11*a* can allow sound caused by the air-sending fans 1 to be a plane wave in the region between the heat exchanger 2 and the air outlet 10. Consequently, sound, which has not been cancelled out in the region between the air-sending fans 1 and the heat exchanger 2, can be cancelled out in the region between the heat exchanger 2 and the air outlet 10. Advantageously, the air-conditioning apparatus (more specifically, the indoor unit) offers a higher sound cancellation effect.

Although Embodiment 9 has been described with respect to the case where lower ends of the partitions 11*a* extend up to the air outlet 10, the lower ends of the partitions 11*a* may, of course, be positioned between the heat exchanger 2 and the air outlet 10. The arranged partitions 11*a* enhance the sound cancellation effect as compared with Embodiment 8.

Embodiment 10

In Embodiment 8 and Embodiment 9, the air-sending fans 1 are equal in number to the air passage sections. Arrangement is not limited to such a pattern. The number of air passage sections may be greater than that of air-sending fans 1. In the following description, the same functions and components as those in Embodiment 8 or Embodiment 9 are designated by the same reference numerals and any item which is not particularly mentioned in Embodiment 10 is the same as that in Embodiment 8 or Embodiment 9.

Figure 15:
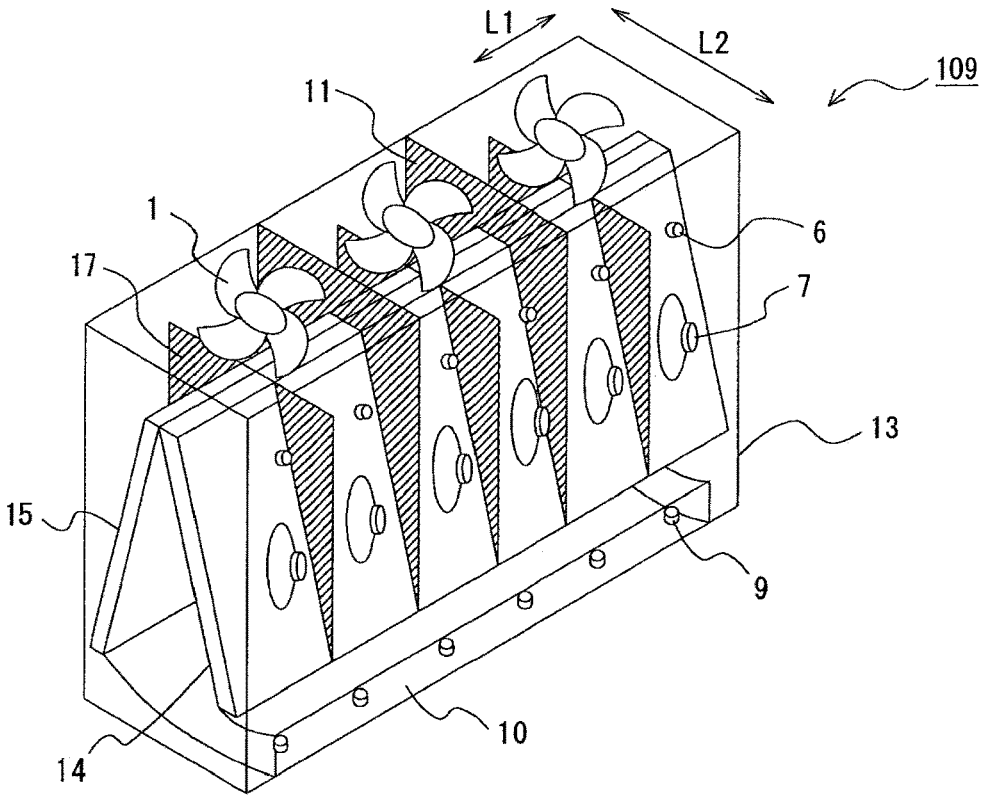
FIG. 15 is a perspective view illustrating an exemplary indoor unit of an air-conditioning apparatus according to Embodiment 10 of the present invention.

FIG. 15 is a perspective view illustrating an exemplary indoor unit of an air-conditioning apparatus according to Embodiment 10 of the present invention. For convenience of understanding, a casing 13 and partitions 11 are illustrated in a transparent manner and a box 8 (back chamber 16), amplifiers 21 to 23, a controller 24, and the like are not illustrated in FIG. 15.

In the indoor unit, 109, according to Embodiment 10, each partition 17 is disposed between the partitions 11. Specifically, each air passage section obtained by division in Embodiment 8 is further divided by the partition 17 in Embodiment 10. The indoor unit 109 according to Embodiment 10 includes sound cancellation units (each including a microphone 6, a control loudspeaker 7, and a microphone 9) equal in number to the air passage sections such that the microphone 6 and the control loudspeaker 7 are arranged in each air passage section. Each microphone 6 is connected through the amplifier 21 to the controller 24. Each control loudspeaker 7 is connected through the amplifier 22 to the controller 24. Each microphone 9 is connected through the amplifier 23 to the controller 24. The rest of the structure is the same as that of the indoor unit 107 according to Embodiment 8.

The indoor unit 109 according to Embodiment 10 cancels out sound caused from air-sending fans 1 in a feedforward control manner. In the case where sound caused from the air-sending fans 1 is cancelled out in a feedback control manner, the microphones 6 and the amplifiers 21 connected to the microphones 6 may be omitted.

Each partition 17 is positioned so as to substantially equally divide the interval between the adjacent partitions 11. The partitions 17, like the partitions 11, may comprise any of various materials. For example, the partitions 11 may comprise metal, such as steel or aluminum. Alternatively, the partitions 11 may comprise, for example, resin. The partitions 17, like the partitions 11, may further have a sound insulation effect. Accordingly, in the case where the partitions 17 are formed using, for example, resin having a lower density than metal (e.g., steel or aluminum), it is preferred to increase the thickness of each partition 17.

An end of each partition 17 adjacent to a heat exchanger 2 is substantially inverted V-shaped along the heat exchanger 2. In the case where the partitions 17 comprise a low melting point material, such as resin, it is preferred to form a small space between each partition 17 and the heat exchanger 2, because the heat exchanger 2 reaches a high temperature during heating operation. In the case where the partitions 17 comprise a high melting point material, such as aluminum or steel, each partition 17 may be disposed in contact with the heat exchanger 2 or may be placed between the fins of the heat exchanger 2.

An end of each partition 17 adjacent to the air-sending fans 1 is shaped such that the end is substantially parallel to the outlet plane of the air-sending fans 1. The end of the partition 17 adjacent to the air-sending fans 1 may be mound-shaped such that part of the partition 17 near the center of rotation of the relevant air-sending fan 1 is the highest and the height of the partition 17 becomes lower toward both sides.

The height of the end of each partition 17 adjacent to the air-sending fans 1 may be set as follows.

For example, in the case where the air-sending fans 1 are close to the heat exchanger 2, if the end of each partition 17 adjacent to the air-sending fans 1 is too close to the relevant air-sending fan 1, the partition 17 will resist the flow of air. Accordingly, in the case where each air-sending fan 1 is close to the heat exchanger 2, it is preferred that the distance between the air-sending fan 1 and the end of the partition 17 adjacent to the air-sending fan 1 be longer as much as possible. In the case where the air-sending fan 1 is close to the heat exchanger 2, therefore, the end of the partition 17 adjacent to the air-sending fan 1 may be set at substantially the same level as an upper end (part closest to the air-sending fan 1) of the heat exchanger 2. The end of the partition 17 adjacent to the air-sending fan 1 may, of course, be positioned on each inclined surface of the heat exchanger 2.

Furthermore, for example, in the case where each air-sending fan 1 is at an adequate distance from the heat exchanger 2, each partition 17 does not resist the flow of air. Accordingly, in the case where the air-sending fan 1 is at an adequate distance from the heat exchanger 2, it is preferred that the end of the partition 17 adjacent to the air-sending fan 1 be positioned at a higher level than the upper end (part closest to the air-sending fan 1) of the heat exchanger 2. Positioning the end of the partition 17 adjacent to the air-sending fan 1 closer to the air-sending fan 1 increases a range of plane sound waves which can be derived from sound caused by the air-sending fan 1.

In the indoor unit 109 with the above-described structure, the length L1 of each air passage section can be less than that in the indoor unit 107 according to Embodiment 8. Accordingly, the indoor unit 109 according to Embodiment 10 enables a sound wave with higher frequency to be a plane wave as compared with the indoor unit 107 according to Embodiment 8, and then enables the sound wave to be cancelled out.

Furthermore, partitions may be arranged in the air passage between the heat exchanger 2 and an air outlet 10 such that each partition is positioned under the corresponding partition 17 in a manner similar to Embodiment 9. This arrangement increases the region where sound caused by the air-sending fans 1 is allowed to be a plane wave in a manner similar to Embodiment 9, thus achieving a higher sound cancellation effect.

Embodiment 11

In Embodiments 8 to 10, the partitions extending in the front-to-rear direction of the casing 13 are arranged to divide the air passage in the casing 13. Additionally, a partition extending in the longitudinal direction of the casing 13 can be placed to further divide the air passage sections in the casing 13. In the following description, the same functions and components as those in Embodiments 8 to 10 are designated by the same reference numerals and any item which is not particularly mentioned in Embodiment 11 is the same as that in Embodiments 8 to 10.

Figure 16:
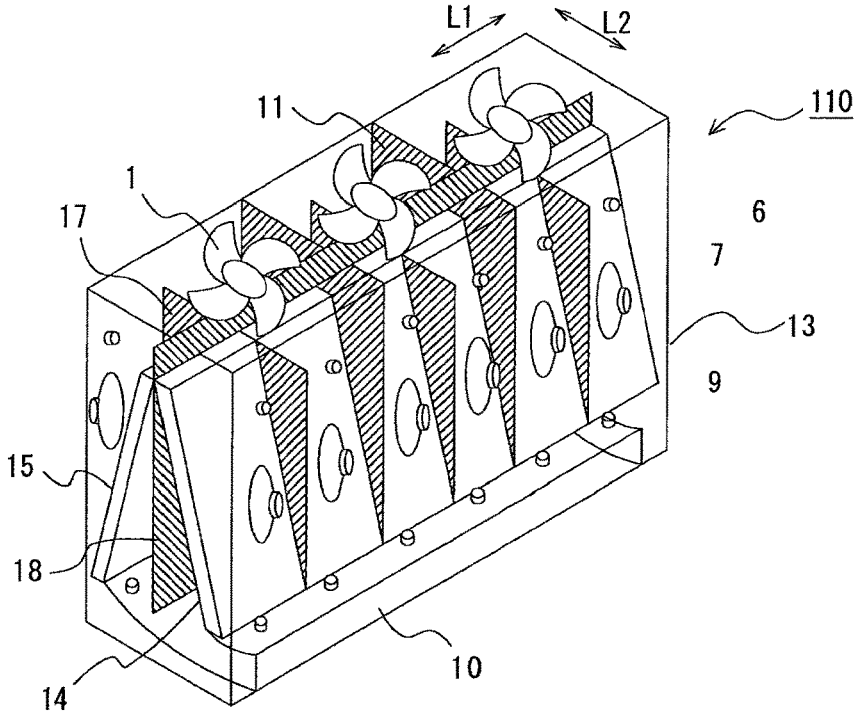
FIG. 16 is a perspective view illustrating an exemplary indoor unit of an air-conditioning apparatus according to Embodiment 11 of the present invention.
Figure 17:
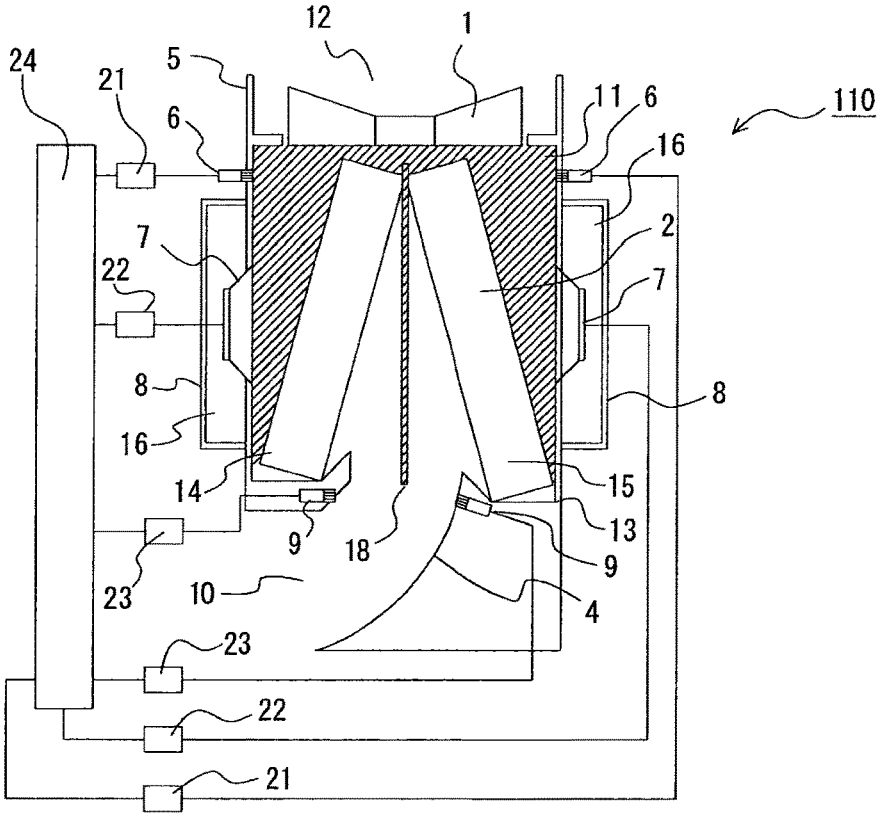
FIG. 17 is a schematic vertical cross-sectional view illustrating an example of the indoor unit of the air-conditioning apparatus according to Embodiment 11 of the present invention.

FIG. 16 is a perspective view illustrating an exemplary indoor unit of an air-conditioning apparatus according to Embodiment 11 of the present invention. FIG. 17 is a schematic vertical cross-sectional view of this indoor unit. In FIG. 16, for convenience of understanding, a casing 13 and partitions 11 are illustrated in a transparent manner and a box 8 (back chamber 16), amplifiers 21 to 23, a controller 24, and the like are not illustrated.

The indoor unit, 110, according to Embodiment 11 has the same fundamental structure as that of the indoor unit 109 according to Embodiment 10. The difference between the indoor unit 110 according to Embodiment 11 and the indoor unit 109 according to Embodiment 10 will be described below.

The indoor unit 110 according to Embodiment 11 includes a partition 18 that longitudinally divides the air passage sections in the casing 13 in the indoor unit 109 according to Embodiment 10. The partition 18 is disposed between a front heat exchanger 14 and a second heat exchanger 15 such that the partition 18 intersects at substantially right angles to the partitions 11 and partitions 17.

The indoor unit 110 according to Embodiment 11 includes sound cancellation units (each including a microphone 6, a control loudspeaker 7, and a microphone 9) equal in number to the air passage sections. The disposed partition 18 allows the air passage sections in the casing 13 to be divided in the front-to-rear direction of the casing 13. In the indoor unit 110 according to Embodiment 11, therefore, the sound cancellation units are arranged not only on the front surface of the casing 13 but also on the rear surface thereof.

More specifically, the microphones 6 for detecting sound caused by a noise source are arranged near the air-sending fans 1, each serving as a sound source. The control loudspeakers 7 for outputting control sound are arranged in the air passage sections downstream from the microphones 6. The microphones 9 for detecting sound in a quiet zone are arranged near a lower end of the partition 18. The microphones 9 may be arranged near an air outlet 10.

Each microphone 6 is connected through the amplifier 21 to the controller 24. Each control loudspeaker 7 is connected through the amplifier 22 to the controller 24. Each microphone 9 is connected through the amplifier 23 to the controller 24.

The indoor unit 110 according to Embodiment 11 cancels out sound caused from the air-sending fans 1 in a feedforward control manner. In the case where sound caused from the air-sending fans 1 is cancelled out in a feedback control manner, the microphones 6 and the amplifiers 21 connected to the microphones 6 may be omitted.

The position of the lower end of the partition 18 (or the end thereof adjacent to the air outlet 10) may be set as follows.

For example, in the case where the partition 18 is a flat plate as illustrated in FIG. 17, if the lower end of the partition 18 excessively extends downward, the air passage will decrease in area (or the air passage will be blocked by the partition 18), so that the lower end may resist the flow of air. In the case where the partition 18 is a flat plate, therefore, the lower end of the partition 18 is positioned upstream from a nozzle 4.

Figure 18:
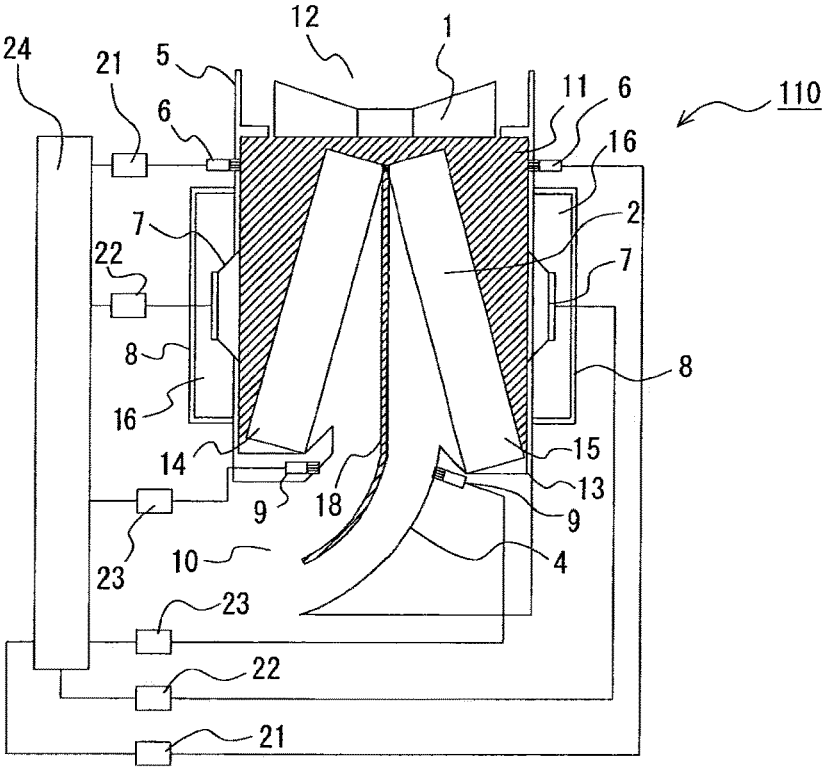
FIG. 18 is a schematic vertical cross-sectional view illustrating another example of the indoor unit of the air-conditioning apparatus according to Embodiment 11 of the present invention.

For example, in the case where the lower end of the partition 18 is curved along the shape of the nozzle 4 as illustrated in FIG. 18, the lower end of the partition 18 may be extended up to the air outlet 10. Extending the lower end of the partition 18 up to the air outlet 10 increases the region where sound caused by the air-sending fans 1 is allowed to be a plane wave, thus achieving a higher sound cancellation effect.

In the indoor unit 110 with the above-described structure, the length L2 of each air passage section can be less than that in the indoor units 107 to 109 according to Embodiments 8 to 10. Accordingly, the indoor unit 110 according to Embodiment 11 enables a sound wave with higher frequency to be a plane wave as compared with the indoor units 107 to 109 according to Embodiments 8 to 10, and then enables the sound wave to be cancelled out.

Embodiment 12

Each partition described in Embodiments 8 to 11 may be provided with a sound absorbing member, which will be described later, on a surface thereof. Alternatively, the partition may be a sound absorbing member. In the following description, the same functions and components as those in Embodiments 8 to 11 are designated by the same reference numerals and any item which is not particularly mentioned in Embodiment 12 is the same as that in Embodiments 8 to 11.

Figure 19:
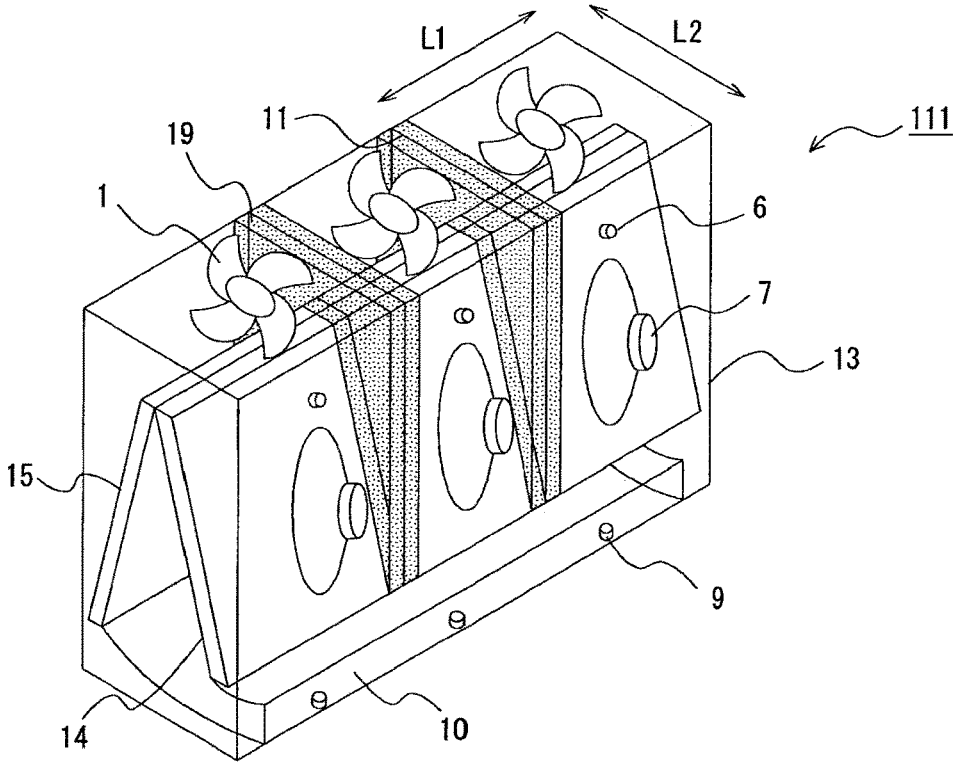
FIG. 19 is a perspective view illustrating an exemplary indoor unit of an air-conditioning apparatus according to Embodiment 12 of the present invention.

FIG. 19 is a perspective view illustrating an exemplary indoor unit of an air-conditioning apparatus according to Embodiment 12 of the present invention. In FIG. 19, for convenience of understanding, a casing 13 and partitions 11 are illustrated in a transparent manner and a box 8 (back chamber 16), amplifiers 21 to 23, a controller 24, and the like are not illustrated. FIG. 19 illustrates a case where sound absorbing members are arranged in the indoor unit 107 according to Embodiment 8.

The indoor unit, 111, according to Embodiment 12 includes a sound absorbing member 19 on each of both surfaces of each partition 11. Examples of a material of the sound absorbing member 19 include urethane, porous resin, and porous aluminum. Such a sound absorbing member 19 has a small effect in deadening low-frequency sound but can deaden sound with high frequencies at and above 1 kHz. The thicker the sound absorbing member 19 is, the lower frequencies can be absorbed. The indoor unit 111 can, however, cancel out sound at and below, for example, 1 kHz using active noise control. Accordingly, the sound absorbing member 19 having a thickness of, for example, 20 mm or less which allows absorption of 2-kHz sound can offer sufficient advantages.

As regards the material of the partitions 11, the partitions 11 may comprise any of various materials in a manner similar to Embodiments 8 to 11. For example, the partitions 11 may comprise metal, such as steel or aluminum. Alternatively, the partitions 11 may comprise, for example, resin. Although the sound absorbing members 19 are arranged on the surfaces of each partition 11, plane wave generation by the partitions 11 can be achieved.

In the indoor unit 111 with the above-described structure, low-frequency sound can be effectively cancelled out by active noise control. Furthermore, the sound absorbing members 19 can deaden high-frequency sound, which is not completely cancelled out by active noise control.

Embodiment 13

Embodiments 8 to 12 have been described with respect to the case where the present invention is applied to the indoor unit in which the air-sending fans 1 are arranged upstream from the heat exchanger 2. The present invention is not limited to this case. The present invention can, of course, be applied to an indoor unit in which an air-sending fan 1 is disposed downstream from a heat exchanger 2. In the following description, the same functions and components as those in Embodiments 8 to 12 are designated by the same reference numerals and any item which is not particularly mentioned in Embodiment 13 is the same as that in Embodiments 8 to 12.

Figure 20:
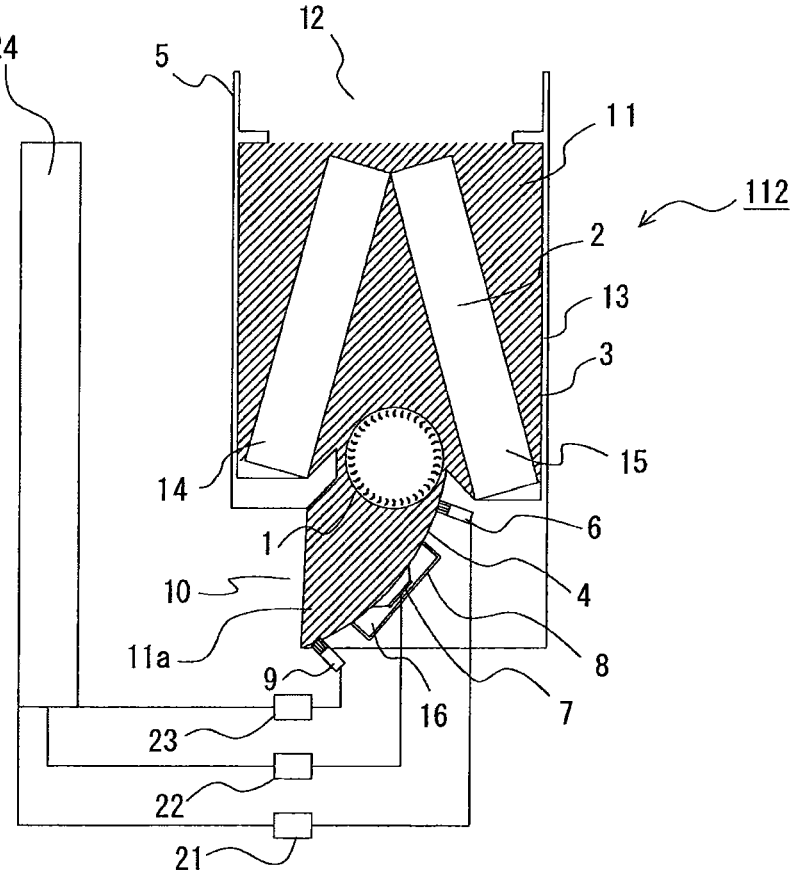
FIG. 20 is a schematic vertical cross-sectional view illustrating an exemplary indoor unit of an air-conditioning apparatus according to Embodiment 13 of the present invention.

FIG. 20 is a schematic vertical cross-sectional view illustrating an exemplary indoor unit of an air-conditioning apparatus according to Embodiment 13 of the present invention.

In the indoor unit, 112, according to Embodiment 13, an air-sending fan 1 is disposed downstream from a heat exchanger 2. The air-sending fan 1 used is a cross flow fan.

In addition, an air passage provided in a casing 13 is divided in a manner similar to Embodiment 9. Specifically, the air passage between an air inlet 12 and the heat exchanger 2 is divided by a partition 11. The air passage between the heat exchanger 2 and an air outlet 10 is divided by a partition 11*a*.

An end of the partition 11 adjacent to the heat exchanger 2 is substantially inverted V-shaped along the heat exchanger 2. In the case where the partition 11 comprises a low melting point material, such as resin, it is preferred to form a small space between the partition 11 and the heat exchanger 2, because the heat exchanger 2 reaches a high temperature during heating operation. In the case where the partition 11 comprises a high melting point material, such as aluminum or steel, the partition 11 may be disposed in contact with the heat exchanger 2 or may be placed between fins of the heat exchanger 2.

An end of the partition 11*a* adjacent to the heat exchanger 2 is also inverted V-shaped. In this case, to prevent water droplets on the surface of the heat exchanger 2 from scattering through the air outlet 10, the partition 11*a* is disposed such that the partition 11*a* is not in contact with the heat exchanger 2.

Additionally, each of the partition 11 and the partition 11*a* may be constituted by a plurality of segments to facilitate attachment of the partitions 11 and 11*a*.

The indoor unit 112 according to Embodiment 13 includes sound cancellation units (each including a microphone 6, a control loudspeaker 7, and a microphone 9) equal in number to air passage sections.

More specifically, the microphones 6 for detecting sound from a noise source are arranged near and downstream from the air-sending fan 1, serving as a sound source. The control loudspeakers 7 for outputting control sound are arranged in the air passage sections downstream from the microphones 6. The microphones 9 for detecting sound in a quiet zone are arranged near the air outlet 10.

Each microphone 6 is connected through an amplifier 21 to a controller 24. Each control loudspeaker 7 is connected through an amplifier 22 to the controller 24. Each microphone 9 is connected through an amplifier 23 to the controller 24.

The indoor unit 112 according to Embodiment 13 cancels out sound caused from the air-sending fan 1 in a feedforward control manner. In the case where sound caused from the air-sending fan 1 is cancelled out in a feedback control manner, the microphones 6 and the amplifiers 21 connected to the microphones 6 may be omitted.

In the indoor unit 112 in which the air-sending fan 1 is disposed downstream from the heat exchanger 2 as described above, sound caused by the air-sending fan 1 can be allowed to be a plane wave. Advantageously, the air-conditioning apparatus (more specifically, the indoor unit) offers a higher sound cancellation effect.

The installation positions of the sound cancellation unit components (the microphone 6, the control loudspeaker 7, and the microphone 9) described in Embodiment 13 are merely exemplary. For example, the control loudspeaker 7 may be placed in each air passage section between the air inlet 12 and the heat exchanger 2 in a manner similar to Embodiments 8 to 12. In this case, the microphone 6 may be placed in each air passage section between the air inlet 12 and the heat exchanger 2 (more specifically, between the control loudspeaker 7 and the heat exchanger 2). This arrangement can reduce sound, caused by the air-sending fan 1, radiated from the air inlet 12.

REFERENCE SIGNS LIST

1, air-sending fan; 2, heat exchanger; 4, nozzle; 6, microphone; 7, control loudspeaker; 8, box; 9, microphone; 10, air outlet; 11, partition; 11*a*, partition; 12, air inlet; 13, casing; 14, front heat exchanger; 15, rear heat exchanger; 16, back chamber; 17, partition; 17*a*, upper end part; 18, partition; 19, sound absorbing member; 21, 22, 23, amplifier; 24, controller; and 100 to 112, indoor unit.

The invention claimed is:

1. An air-conditioning apparatus comprising:

a casing having an air inlet and an air outlet, the casing having an air passage therein;

a heat exchanger and a plurality of air-sending fans which are arranged in the air passage in the casing, a lowermost surface of the plurality of air-sending fans defining an outlet plane, wherein the plurality of air-sending fans are placed upstream of the heat exchanger, each of the plurality of air-sending fans is an axial flow fan or a mixed flow fan, a rotation axis of the axial flow fans or the mixed flow fans extending toward the heat exchanger, at least one partition is disposed between adjacent ones of the plurality of the air-sending fans, the at least one partition is positioned at least in a region between the heat exchanger and the outlet plane of the plurality of air-sending fans, the at least one partition dividing, between the adjacent ones of the plurality of air-sending fans, the air passage through which air blown by the plurality of air-sending fans to the heat exchanger passes, and the at least one partition is arranged such that the at least one partition is not in contact with the heat exchanger.

2. The air-conditioning apparatus of claim 1, wherein the at least one partition is further placed interspace of the heat exchanger and the air outlet.

3. The air-conditioning apparatus of claim 1, wherein at least an upper end part of the at least one partition is disposed at an angle to the outlet plane of the plurality of air-sending fans.

4. The air-conditioning apparatus of claim 1, wherein the at least one partition is constituted by a plurality of plate members.

5. The air-conditioning apparatus of claim 1, wherein the at least one partition includes a sound absorbing member.

6. The air-conditioning apparatus of claim 1, further comprising:

a sound cancellation unit including at least one sound detection device and a control sound output device that outputs control sound; and a control sound generating device that produces the control sound on the basis of at least one result detected by the sound detection device, wherein the sound cancellation unit is one of a plurality of sound cancellation units, the at least one partition divides the air passage in the casing into a plurality of air passage sections, and wherein at least the control sound output device of the sound cancellation unit is placed in each air passage section.

7. The air-conditioning apparatus of claim 6, wherein the control sound output device of the sound cancellation unit is placed between the plurality of air-sending fans and the heat exchanger.

8. The air-conditioning apparatus of claim 1, wherein the heat exchanger has an inclined surface inclined with respect to the outlet plane of the plurality of air-sending fans at an upstream side, and an end of the at least one partition located upstream of the inclined surface is inclined with respect to the outlet plane along the inclined surface.

9. The air-conditioning apparatus of claim 8, wherein the heat exchanger is inverted V-shaped, and an end portion of the at least one partition located upstream of the heat exchanger is inverted V-shaped.

10. The air-conditioning apparatus of claim 1, wherein the air-conditioning apparatus is a wall-mounted indoor unit in which the air inlet is disposed on an upper side of the casing and the air outlet is disposed on a lower side of the casing, the casing has a longitudinal direction, the heat exchanger extends in the longitudinal direction in the casing, the plurality of air-sending fans are arranged in the longitudinal direction in the casing, the at least one partition divides the air passage in the casing into a plurality of sections.

11. The air-conditioning apparatus of claim 1, wherein the at least one partition comprises resin, and is located spaced apart from the heat exchanger.

12. The air-conditioning apparatus of claim 1, wherein the heat exchanger includes a front heat exchanger and a rear heat exchanger, the at least one partition extends from a first side surface of the front heat exchanger to a second side surface of the rear heat exchanger in the region between the heat exchanger and the outlet plane.

13. The air-conditioning apparatus of claim 1, wherein at least a portion of the at least one partition is positioned adjacent at least one side surface of the heat exchanger.

* * * * *